US009773371B2

(12) United States Patent
Arnone et al.

(10) Patent No.: US 9,773,371 B2
(45) **Date of Patent: *Sep. 26, 2017**

(54) INTERMEDIATE CREDIT HYBRID GAMING SYSTEM

(71) Applicant: Gamblit Gaming, LLC, Glendale, CA (US)

(72) Inventors: Miles Arnone, Sherborn, MA (US); Frank Cire, Pasadena, CA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/298,533

(22) Filed: Oct. 20, 2016

(65) Prior Publication Data

US 2017/0039805 A1 Feb. 9, 2017

Related U.S. Application Data

(63) Continuation of application No. 14/842,684, filed on Sep. 1, 2015, now Pat. No. 9,489,797, which is a continuation of application No. PCT/US2014/020041, filed on Mar. 3, 2014.

(60) Provisional application No. 61/772,248, filed on Mar. 4, 2013, provisional application No. 61/771,376, filed on Mar. 1, 2013, provisional application No. 61/771,355, filed on Mar. 1, 2013.

(51) Int. Cl.
*G07F 17/32* (2006.01)
*G07F 17/34* (2006.01)

(52) U.S. Cl.
CPC ..... *G07F 17/3225* (2013.01); *G07F 17/3244* (2013.01); *G07F 17/3276* (2013.01); *G07F 17/3286* (2013.01); *G07F 17/3295* (2013.01); *G07F 17/34* (2013.01)

(58) Field of Classification Search
CPC ..... G07F 17/32
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |
| 6,267,669 | B1 | 7/2001 | Luciano |
| 6,685,563 | B1 | 2/2004 | Meekins et al. |
| 6,712,693 | B1 | 3/2004 | Hettinger |
| 6,761,632 | B2 | 7/2004 | Bansemer et al. |

(Continued)

OTHER PUBLICATIONS

U.S. Appl. No. 14/205,303 Arnone, et al., filed Mar. 11, 2014.

(Continued)

*Primary Examiner* — Omkar Deodhar
(74) *Attorney, Agent, or Firm* — Caitlyn Ross

(57) ABSTRACT

An intermediate credit hybrid game that awards a player an intermediate credit. The intermediate credit is awarded to the player on the based on an outcome of a wager that was made in a gambling game but triggered by the player's play of a skill-based entertainment game. The intermediate credit may be converted by the player into an in-game resource within the entertainment game.

14 Claims, 17 Drawing Sheets

(56) References Cited

U.S. PATENT DOCUMENTS 6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,864,564 B2 10/2014 Oberberger
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly

(56) References Cited

U.S. PATENT DOCUMENTS

| | | | |
|---|---|---|---|
| 2009/0181777 | A1 | 7/2009 | Christiani |
| 2009/0221355 | A1 | 9/2009 | Dunaevsky et al. |
| 2009/0239610 | A1 | 9/2009 | Olive |
| 2009/0247272 | A1 | 10/2009 | Abe |
| 2009/0270164 | A1 | 10/2009 | Seelig |
| 2009/0275393 | A1 | 11/2009 | Kisenwether |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0029373 | A1 | 2/2010 | Graham et al. |
| 2010/0035674 | A1 | 2/2010 | Slomiany |
| 2010/0056247 | A1 | 3/2010 | Nicely |
| 2010/0056260 | A1 | 3/2010 | Fujimoto |
| 2010/0062836 | A1 | 3/2010 | Young |
| 2010/0093420 | A1 | 4/2010 | Wright |
| 2010/0093444 | A1 | 4/2010 | Biggar et al. |
| 2010/0105454 | A1 | 4/2010 | Weber |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0184509 | A1 | 7/2010 | Sylla et al. |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0285869 | A1 | 11/2010 | Walker |
| 2010/0304825 | A1 | 12/2010 | Davis |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0045896 | A1 | 2/2011 | Sak et al. |
| 2011/0070945 | A1 | 3/2011 | Walker |
| 2011/0077087 | A1 | 3/2011 | Walker et al. |
| 2011/0082571 | A1 | 4/2011 | Murdock et al. |
| 2011/0105206 | A1 | 5/2011 | Rowe et al. |
| 2011/0107239 | A1 | 5/2011 | Adoni |
| 2011/0109454 | A1 | 5/2011 | McSheffrey |
| 2011/0111820 | A1 | 5/2011 | Filipour |
| 2011/0111837 | A1 | 5/2011 | Gagner |
| 2011/0111841 | A1 | 5/2011 | Tessmer |
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0230267 | A1 | 9/2011 | Van Luchene |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2011/0319169 | A1 | 12/2011 | Lam |
| 2012/0004747 | A1 | 1/2012 | Kelly |
| 2012/0028718 | A1 | 2/2012 | Barclay et al. |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0135793 | A1 | 5/2012 | Antonopoulos |
| 2012/0202587 | A1 | 8/2012 | Allen |
| 2012/0302310 | A1 | 11/2012 | Kelly |
| 2012/0302311 | A1 | 11/2012 | Luciano |
| 2012/0322545 | A1 | 12/2012 | Arnone et al. |
| 2013/0029760 | A1 | 1/2013 | Wickett |
| 2013/0131848 | A1 | 5/2013 | Arnone et al. |
| 2013/0190074 | A1 | 7/2013 | Arnone et al. |
| 2013/0260869 | A1 | 10/2013 | Leandro et al. |
| 2014/0087801 | A1 | 3/2014 | Nicely et al. |
| 2014/0087808 | A1 | 3/2014 | Leandro et al. |
| 2014/0087809 | A1 | 3/2014 | Leupp et al. |
| 2014/0357350 | A1 | 12/2014 | Weingardt et al. |

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
WIPO/IPEA International Preliminary Report on Patentability, PCT/US14/20041, Jun. 23, 2014.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.

(56) References Cited

OTHER PUBLICATIONS

U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 1/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.

(56) References Cited

OTHER PUBLICATIONS

U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.

INTERMEDIATE CREDIT HYBRID GAMING SYSTEM

CROSS-REFERENCE TO RELATED APPLICATIONS

The current application is a continuation of U.S. patent application Ser. No. 14/842,684, filed Sep. 1, 2015, which is a continuation of Patent Cooperation Treaty Application No. PCT/US14/20041, filed Mar. 3, 2014, which claims the benefit of U.S. Provisional Application No. 61/771,355, filed Mar. 1, 2013, 61/771,376, filed Mar. 1, 2013 and 61/772,248, filed Mar. 4, 2013, each disclosure of which is hereby incorporated by reference herein in its entirety. This application references Patent Cooperation Treaty Application Nos. PCT/US12/58156, filed Sep. 29, 2012, PCT/US11/26768, filed Mar. 1, 2011, PCT/US11/63587, filed Dec. 6, 2011, and PCT/US12/50204 filed Aug. 9, 2012, each disclosure of which is hereby incorporated by reference herein in its entirety.

FIELD OF THE INVENTION

Embodiments of the present invention are generally related to entertainment games having an interleaved gambling proposition and more specifically to credit systems linking resources in the entertainment game with gambling outcomes.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of game. An example of such a game would be a challenging word spelling game, or an interactive action game such as is found on video game consoles popular today, such as a PlayStation®, an Xbox®, a Wii® or a PC based game.

SUMMARY OF THE INVENTION

The disclosed embodiments relate generally to an interactive entertainment game where skill and chance may coalesce to provide a rich arcade-style gaming experience, visually exciting and challenging, where players may wager cash, credits prizes and points in order to win more of the foregoing. Many of the embodiments of the design provide an enticing method of gaming to the players who expect a high level of entertainment content in their gaming experience compared to the relatively simple game methods in use today.

In accordance with embodiments of this invention, systems and methods for an intermediate credit hybrid game are provided. Systems and methods in accordance with embodiments of this invention provide an intermediate credit hybrid gaming system, including a processing device, connected to a game world server via a network, constructed to execute an entertainment game of skill, determine an occurrence of a utilization of an element by a player during skillful play of the entertainment game of skill, communicate, to the game world server via the network, a signal to execute a wager of real world credits triggered by the utilization of the element by the player during skillful play of the entertainment game of skill, receive, from the game word server, via the network, a signal including an outcome of a wager of real world credits triggered by the utilization of the element by the player during skillful play of the entertainment game of skill, display the outcome of the wager of real world credits triggered by the utilization of the element by the player during skillful play of the entertainment game, receive, from the game world server, via the network, a signal including an amount of intermediate credit to award the player, display the amount of intermediate credit to award the player, and receive from the player an input of a selection of a conversion of the amount of intermediate credit into the element to be utilized by the player in the entertainment game. The gaming system is further constructed to include a real world server, connected to the game world server via a communication link, constructed to receive, from the game world server, via the communication link, a signal to execute a wager of real world credits triggered by the utilization of the element by the player during skillful play of the entertainment game of skill, determine the outcome of the wager of real world credits triggered by the utilization of the element by the player during skillful play of the entertainment game of skill, and communicate, to the game world server, via the communication link, the signal including the outcome of the wager of real world credits triggered by the utilization of the element by the player during skillful play of the entertainment game of skill. The gaming system is further constructed to include the game world server, connected to the processing device via the network and connected to the real world server via the communication link, constructed to continuously monitor the processing device's execution of the entertainment game of skill for a signal including the occurrence of the utilization of the element by the player during skillful play of the entertainment game of skill, receive, from the processing device, via the network, the signal to execute the wager of real world credits triggered by the utilization of the element by the player during skillful play of the entertainment game of skill, communicate, to the real world server, via the communication link, the signal to execute the wager of real world credits triggered by the utilization of the element by the player during skillful play of the entertainment game of skill, receive, from the real world server, via the communication link, the signal including the outcome of the wager of real world credits triggered by the utilization of the element by the player during skillful play of the entertainment game of skill, communicate, to the processing device, the signal including the outcome of the wager of real world credits triggered by the utilization of the element by the player during skillful play of the entertainment game of skill, generate the amount of intermediate credit to award the player, wherein a determining of the amount of intermediate credit to award the player is based on the outcome of the wager of real world credits triggered by the utilization of the element by the player during skillful play of the entertainment game of skill, and communicate, to the processing device, via the network, the signal including the amount of intermediate credit to award the player.

In accordance with numerous embodiments of the invention the game world server is further constructed to generate the amount of intermediate credit further using an amount of game world credit accumulated by the player.

In accordance with various embodiments of the invention the game world server is further constructed to generate the amount of intermediate credit further using one or more entertainment game variables.

In accordance with many embodiments of the invention the element when utilized by the player in the entertainment game triggers the determination of the result of the wager of real world credits.

In accordance with numerous embodiments of the invention the amount of intermediate credit can be used as a mechanism to fund tournament entry.

DETAILED DESCRIPTION

Turning now to the drawings, systems and methods for providing an intermediate credit hybrid game that provides an intermediate credit hybrid game are disclosed. In accordance with many embodiments of this invention, an intermediate credit hybrid game integrates high-levels of entertainment content with a game of skill (an entertainment game) and a gambling experience with a game of chance (a gambling game). An intermediate credit hybrid game provides for random outcomes independent of player skill while providing that the user's gaming experience (as measured by obstacles/challenges encountered, time of play and other factors) is shaped by the player's skill.

Figure 1:
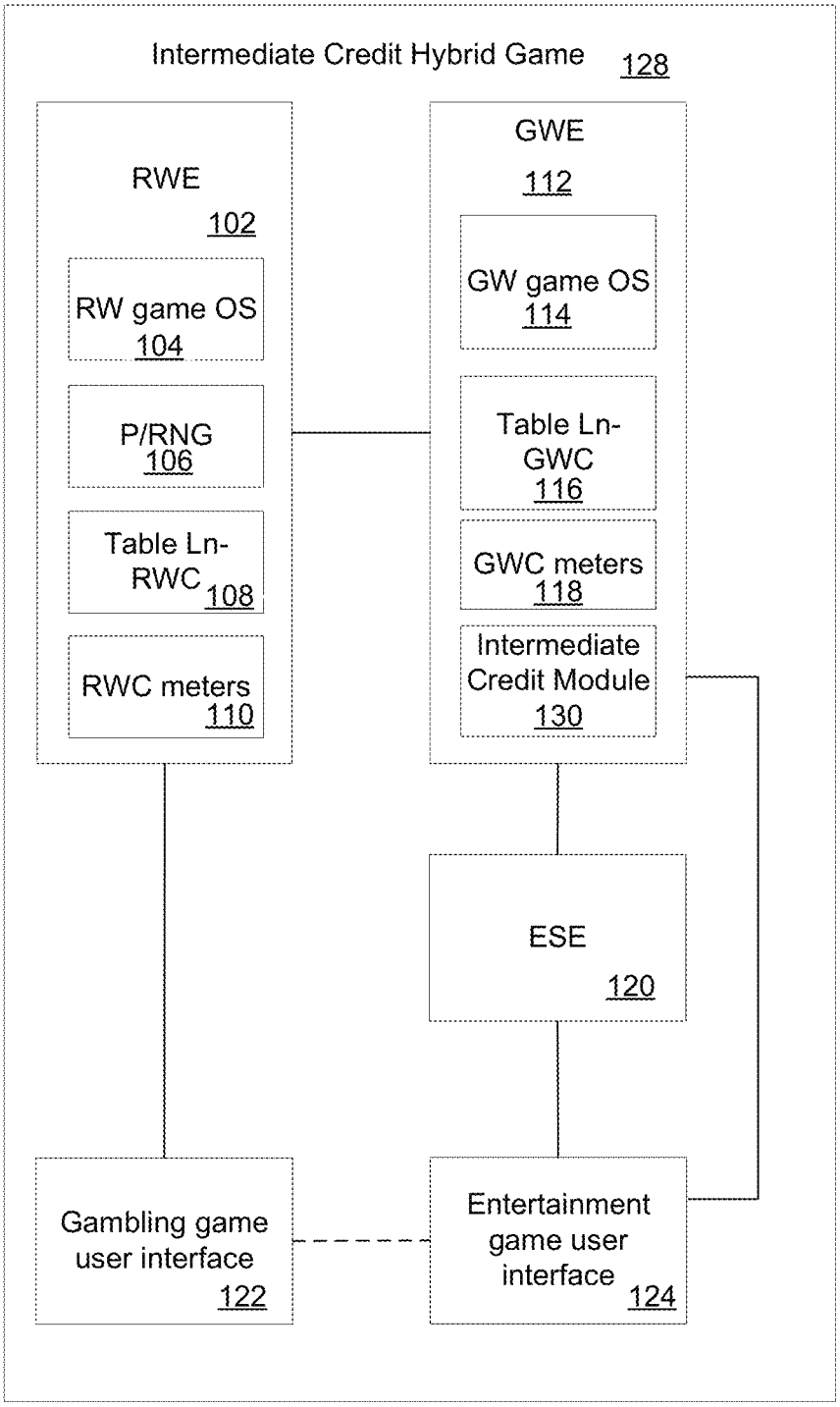
FIG. 1 illustrates a conceptual diagram of components of an intermediate credit hybrid game in accordance with an embodiment of the invention.

In an intermediate credit hybrid game, an outcome of a gambling proposition is determined by a pseudo random or random number generator (P/RNG) or other such device that provides a random outcome in response to a wager. In accordance with some embodiments, the wager may be initiated in response to a game object related player action. An intermediate credit hybrid game in accordance with an embodiment of the invention is illustrated in FIG. 1.

In accordance with many embodiments of this invention, an intermediate credit hybrid game integrates high-levels of entertainment content with a game of skill (an entertainment game) and a gambling experience with a game of chance (a gambling game). An intermediate credit hybrid game provides for random outcomes independent of player skill while providing that the user's gaming experience (as measured by obstacles/challenges encountered, time of play and other factors) is shaped by the player's skill. The outcome of a gambling proposition that is determined by a pseudo random or random number generator (P/RNG) or other such device that provides a random outcome in response to a request. In accordance with some embodiments, the wager game may be initiated in response to a game object related player action. An intermediate credit hybrid game in accordance with an embodiment of the invention is illustrated in FIG. 1. The intermediate credit hybrid game 128 includes a Real World Engine (RWE) 102, a Game World Engine (GWE) 112, an Entertainment System Engine (ESE) 120, a gambling game user interface 122 and an entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is also operatively connected with the entertainment game user interface 124.

In accordance with several embodiments, the RWE 102 is the operating system for the gambling game of the intermediate credit hybrid game 128 and controls and operates the gambling game. The operation of a gambling game is enabled by Real World Currency (RC), such as money or other real world funds. A gambling game can increase or decrease an amount of RC based on random gambling outcomes, where the gambling proposition of a gambling game is typically regulated by gaming control bodies. In many embodiments, the RWE 102 includes a Real World (RW) operating system (OS) 104, pseudo random or random number generator P/RNG 106, level n real-world credit pay tables (Table Ln-RC) 108, RC meters 110 and other software constructs that enable a game of chance to offer a fair and transparent gambling proposition, and to contain the auditable systems and functions that can enable the game to obtain gaming regulatory body approval.

The P/RNG 106 includes software and/or hardware algorithms and/or processes, which are used to generate random outcomes. A level n real-world credit pay table (Table Ln-RC) 108 is a table that can be used in conjunction with the P/RNG 106 to dictate the RC earned as a function of sponsored gameplay and is analogous to the pay tables used in a conventional slot machine. Table Ln-RC payouts are independent of player skill. There can be one table or multiple tables included in Ln-RC pay tables 108 contained in a gambling game, the selection of which can be determined by factors including (but not limited to) game progress that a player has earned, and/or bonus rounds for which a player can be eligible. RCs are credits analogous to slot machine game credits, which are entered into a gambling game by the user, either in the form of money such as hard currency or electronic funds. RCs can be decremented or augmented based on the outcome of a random number generator according to the table Ln-RC real world credits pay table 108, independent of player skill. In certain embodiments, an amount of RC can be used as criteria in order to enter higher ESE game levels. RC can be carried forward to higher game levels or paid out if a cash out is opted for by a player. The amount of RC used to enter a specific level of the game, level n, need not be the same for each level.

In accordance with some embodiments of this invention, the GWE 112 manages the overall intermediate credit hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an Operating System (OS) 114 that provides control of the entertainment game. The GWE additionally contains a level n game world credit pay table (table Ln-GWC) 116 from where to take input from this table to affect the play of the entertainment game. The GWE 112 can further operatively connect to the RWE 102 to determine the amount of RC available on the game and other metrics of wagering on the gambling game (and potentially affect the amount of RC in play on the RWE). The GWE additionally contains various audit logs and activity meters (such as the GWC meter) 118. The GWE 112 can also operatively connect to a centralized server for exchanging various data related to the player and his or her activities in the game. The GWE 112 furthermore operatively connects to the ESE 120.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be operatively connected to a P/RNG. In accordance with some embodiments, GWCs are player points earned or depleted as a function of player skill, specifically as a function of player performance in the context of the entertainment game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RC available in the gambling game. The communication link can also convey a status operation of the RWE (such as on-line or tilt). The communication link can further communicate the various gambling control factors which the RWE 102 uses as input, such as the number of RC consumed per game or the player's election to enter a jackpot round. In FIG. 1, the GWE 112 is also shown as connecting to the player's user interface directly, as this can be utilized to communicate certain entertainment game club points, player status, control the selection of choices and messages which a player can find useful in order to adjust the entertainment game experience or understand their gambling status in the RWE 102.

The GWE may further include an intermediate credit module 130 that is utilized by the GWE for implementing various operations of the intermediate credit hybrid game as described herein.

In accordance with various embodiments of this invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a user interface. In accordance with many embodiments, the ESE 120 can exchange data with and accept control information from the GWE 112. In accordance with some of these embodiments, an ESE 120 can be implemented using a Personal Computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 can be an electromechanical game system of an intermediate credit hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special potion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RC in play, and amount of RC available. The RWE 102 can accept modifications in the amount of RC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, an intermediate credit hybrid game integrates a video game style gambling machine, where the gambling game (including an RWE 102 and RC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the intermediate credit hybrid game can leverage very popular titles with gamers and provides a sea change environment for casinos to attract players with games that are more akin to the type of entertainment that a younger generation desires. In accordance with various embodiments, players can use their skill towards building and banking Game World Credit (GWC) that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, intermediate credit hybrid games also allow players to gain entry into subsequent competitions through the accumulation of Game World Credits (GWC) as a function of the user's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The intermediate credit hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

In accordance with some embodiments, the use of the RWE, GWE and ESE allows for the separation of control of an intermediate credit hybrid game between different devices. For example, the ESE may be hosted by a device that is separate from any devices that host the RWE and/or GWE. Through separation of control of the functions of the ESE, RWE and GWE, the RWE may be isolated from the player's device, thus preventing player interference with the RWE and the gambling game. In addition, as the ESE is responsible for providing the entertainment game, intermediate credit hybrid games may provide for complex entertainment games for the player as the ESE need not include the tightly regulated components of the RWE, thus providing for more freedom in ESE design. Also, separation of control allows a GWE to provide complex wager initiation rules that would not be possible if the either the ESE or the RWE were to be in control of the wager initiation.

In accordance with various embodiments, an intermediate credit hybrid game allows for interleaving of continuous wagering within an entertainment game. For example, instead of wagering once, and then playing an entertainment game to completion, or playing an entertainment game to completion and then placing a wager, an intermediate credit hybrid game allows a gaming system or device to be provided to a player where the gaming system or device provides a complex and interesting entertainment game with wagering incorporated throughout the entertainment game.

In various embodiments, an intermediate credit hybrid game provides for feedback into the entertainment game of additional entertainment game resources that are made available in the ESE for the use of the player as the result of wagering outcomes. The additional entertainment game resources may enable portions of the entertainment game that were not available to the player without the resources.

In many embodiments, an intermediate credit hybrid game provides the ability to use the intermediate credit hybrid game in more than one jurisdiction, as the ESE is a component separate from the GWE and RWE. For example, the ESE may be operated as either a pure entertainment game, or as a gambling game depending on the type of characteristics of the RWE that the ESE is operatively connected to.

In some embodiments, an intermediate credit hybrid game provides for display of an entertainment game on a player's device that the player is using to interact with the entertainment game, as well as providing a separate display of a state of a gambling game on a separate gambling game display. The separate gambling game display may be on the player's device within the same physical display device, on a separate device having a separate physical screen, or on a separate physical display device on the player's device.

Figure 2:
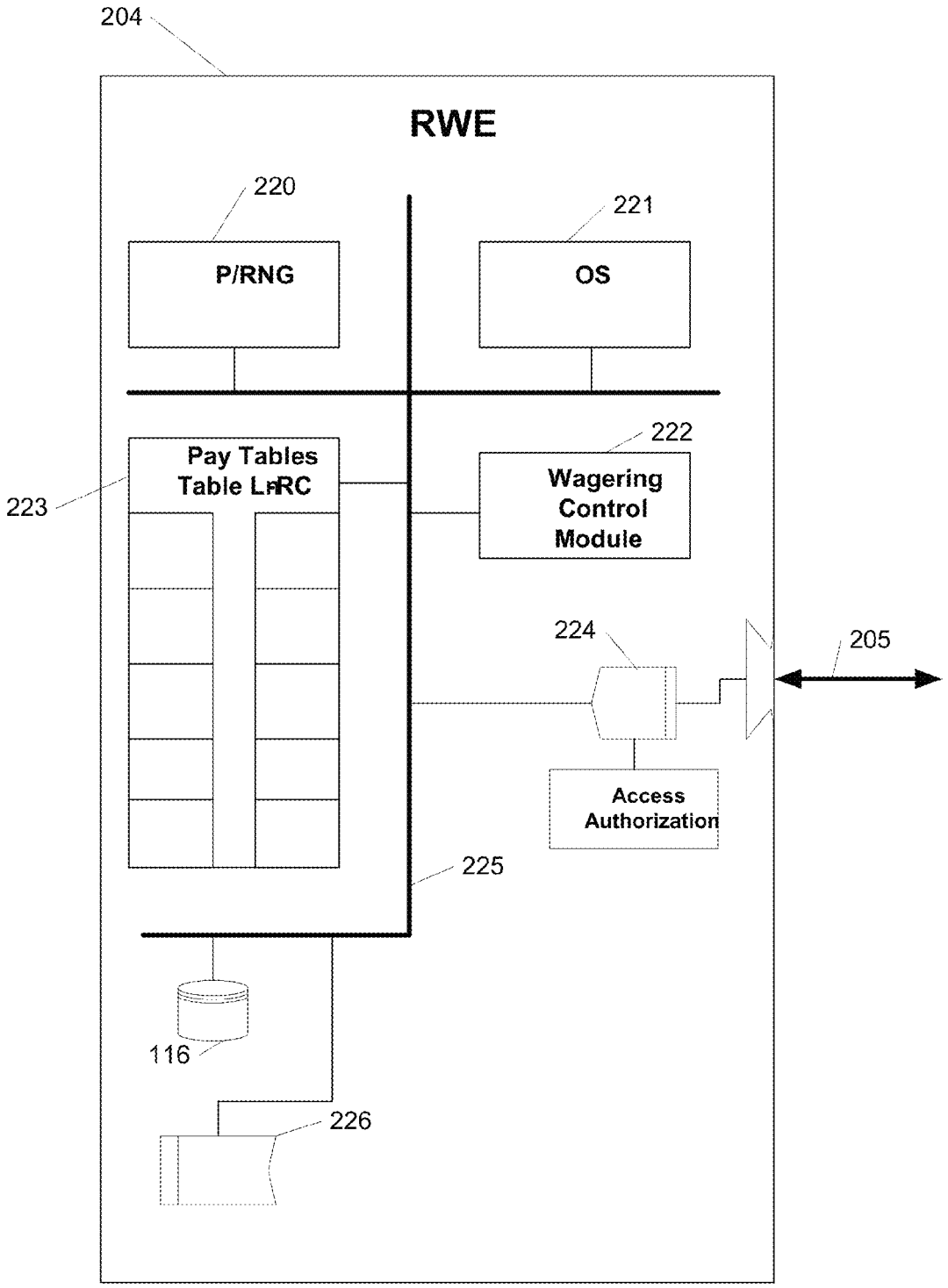
FIG. 2 illustrates a conceptual diagram of aspects of a Real World Engine (RWE) of an intermediate credit hybrid game in accordance with some embodiments of the invention.

The components provided by the RWE for an intermediate credit hybrid game in accordance with embodiments of the invention are shown in FIG. 2. In accordance with embodiments of the invention, the RWE includes an internal bus 225 that connects an operating system OS 221, a pseudo random or random number generator (P/RNG) 220, one or more pay tables (Table Ln-RC) 223, a wagering control module 222, an authorization access module 224, and a RC credit meter 226 that are included in the RWE 204. The RW OS 221 controls the functions of the RWE 204. The P/RNG 220 includes one or more P/RNGs that are used to produce random numbers for use in resolving gambling events and other process requiring a random number to determine an outcome. The one or more pay tables (Table Ln-RC) 223 control the functions of the RWE and contain a plurality of factors indexed by the random number to be multiplied with the RC wagered to determine the payout on a successful wager. A wagering control module 222 performs the processes to resolve a wager on a proposition of a gambling event. The resolution process includes, but is not limited to, pulling random numbers, looking up factors in Pay Tables, multiplying the factors by the amount of RC wagered, and administering a RC credit meter 226. A repository (a credit meter) 226 maintains a record of the amount of RC which a player has deposited in the game and has been accumulated by the player.

An external connection allows the RWE 204 to interface to another system or device, which is shown in FIG. 2 as the Internet 205 but may be any other network and/or device. The authorization access module 224 of RWE 204 is connected to the external connection and provides a method to permit access and command exchange between an external system and the RWE 204. The RWE 204 also contains storage for statuses, wagers, wager outcomes, meters and other historical events in a storage device 116.

Figure 3:
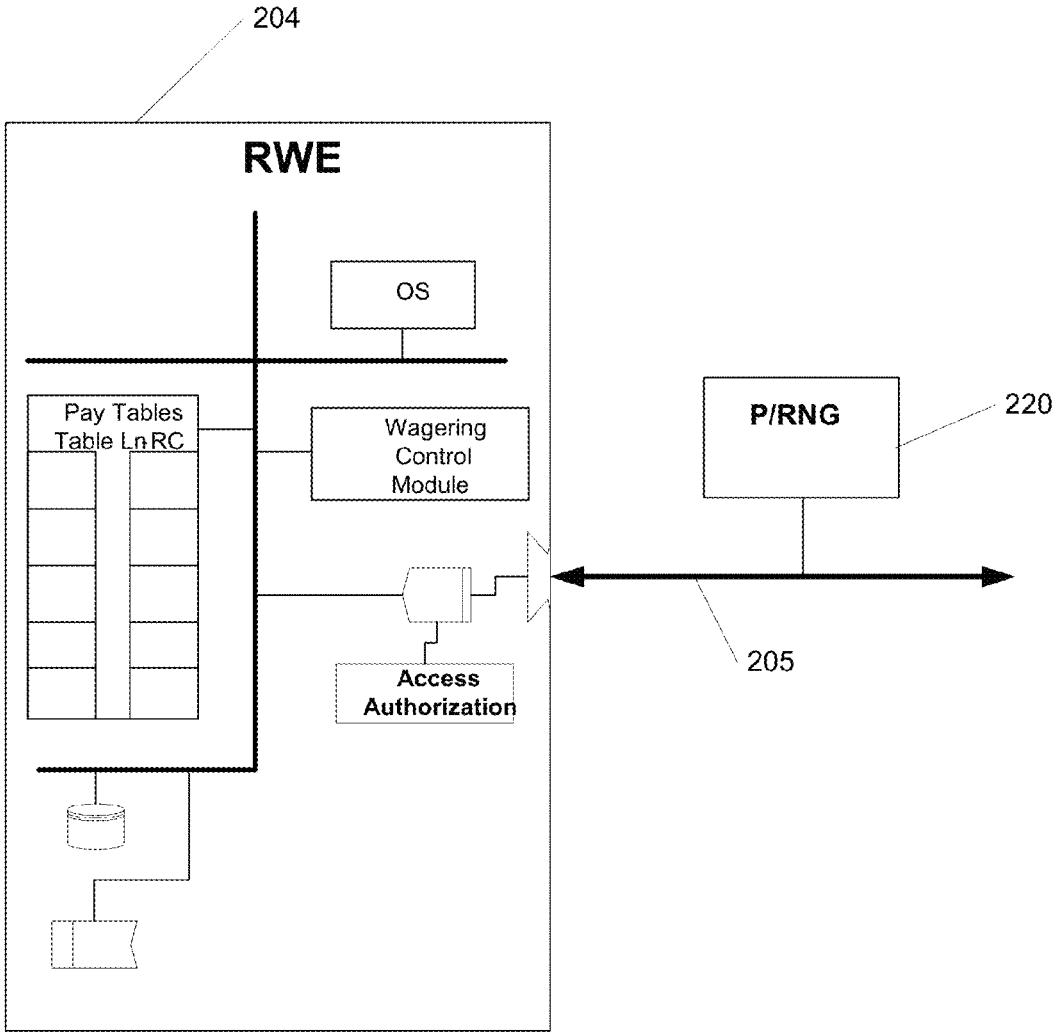
FIG. 3 illustrates a conceptual diagram of aspects of a Real World Engine (RWE) of an intermediate credit hybrid game in accordance with some other embodiments of the invention.

In some embodiments, the RWE 204 communicates with external systems to provide various functions of an intermediate credit hybrid game in accordance with embodiments of the invention. The components of an RWE 204 that communicate with an external system to provide a component of the RWE 204 in accordance with embodiments of the invention are shown in FIG. 3. The RWE 204 shown in FIG. 3 is similar to the RWE shown in FIG. 2. However, the P/RNG 220 is an external system connected to the RWE 204 by the Internet 205 in accordance with embodiments of the invention. The P/RNG 220 could be a central deterministic system, such as a regulated and controlled random numbered ball selection device, or some other system which provides random or pseudo random numbers to one or a plurality of connected RWEs 204. One skilled in the art will recognize that only P/RNG 220 is an external system in the embodiment illustrated in FIG. 3. However, any of the components could be external systems without departing from the invention and P/RNG 220 is shown as an example only.

In FIGS. 2 and 3, the RWE 204 interfaces with other systems/devices or to an external P/RNG 220 using the Internet 205. However, one skilled in the art will note that nothing would preclude using a different interface than the Internet 205 in other embodiments of the invention. Other examples of interfaces include, but are not limited to, a LAN, a USB interface, or some other method by which two electronic and software constructs could communicate with each other.

Figure 4:
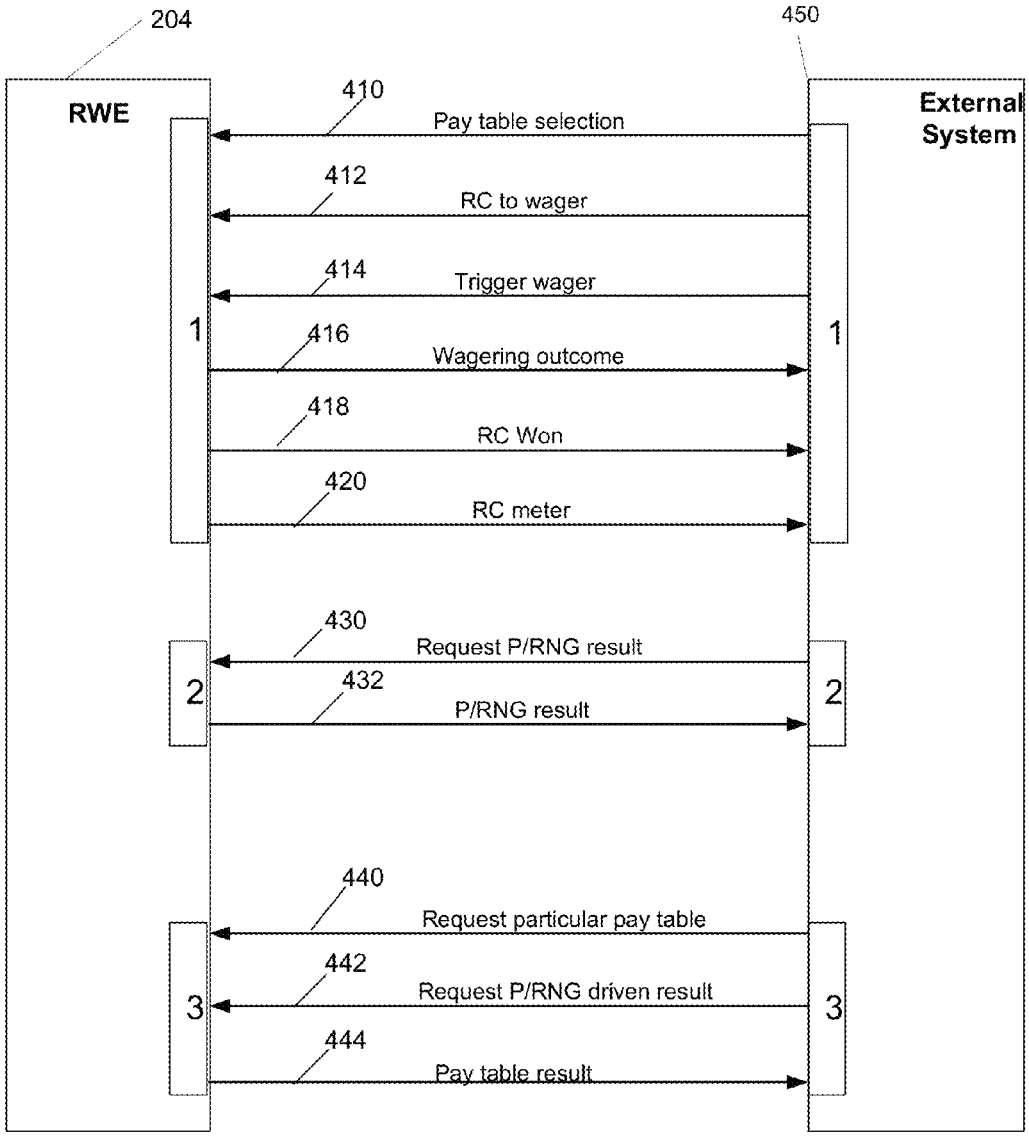
FIG. 4 illustrates a signaling diagram of communications between a Real World Engine (RWE) and an external system to provide various functions in accordance with embodiments of the invention.

The RWE and an external system typically communicate to provide the resolution of gambling events to resolve wagers on the events. The signals between the RWE and an external system to provide some process related to resolving gambling events in accordance with embodiments of the invention are shown in FIG. 4. In accordance with many embodiments of the invention, the primary function of the RWE 204 is to manage wagering events and to provide random (or pseudo random) numbers from a P/RNG. At the top of the figure, a 6 component communication exchange grouped by the "1" box is shown for a wager on a proposition in a gambling event during an intermediate credit hybrid game in accordance with embodiments of the invention. An external system 450 that is requesting wagering support from the RWE 204 instructs the RWE 204 as to the pay table (Table Ln-RC) to use (410), followed by the amount of RC to wager on the proposition of the gambling event (412). Next, the external system 450 signals the RWE to trigger a wager or perform the gambling event (414). The RWE 204 resolves the gambling event. The RWE 204 then informs external system 450 as to the outcome of the wager (416), the amount of RC won (418), and the amount of RC in the player's account (in the credit repository) (420).

A second communication exchange between the RWE 204 and an external system 450 in accordance with embodiments of the invention that is shown in FIG. 4 is grouped by the "2" box in FIG. 4 and relates to the external system 450 needing an P/RNG result support from the RWE 204. In this exchange, the external system 450 requests an P/RNG result from the RWE 204 (430). The RWE 204 returns a P/RNG result to the external system 450 in response to the request (432). The result may be generated as a function of the internal P/RNG in the RWE 204, or from a P/RNG external to the RWE 204 to which the RWE 204 is connected.

A third communication exchange between the RWE 204 and the external system 450 in accordance with embodiments of the invention that is shown in FIG. 4 is grouped by the "3" box in the figure and relates to the external system 450 wanting support on coupling an P/RNG result to a particular Pay Table contained in the RWE 204. In this exchange, the external system 450 instructs the RWE as to the pay table (Table Ln-RC) to use (440). The external system (450) then requests a result whereby the P/RNG result is coupled to the requested Pay Table (442). The result is returned to the external system 450 by RWE 204 (444). Such an aspect is different from the first exchange shown by the box "1" sequence in that no actual RC wager is conducted. However, such a process, t, might be useful in coupling certain non-RC wagering entertainment game behaviors and propositions to the same final resultant wagering return which is understood for the intermediate credit hybrid game to conduct wagering.

In regards to FIG. 4, one skilled in the art will note that the thrust of the FIG. 4 is to convey overall functional exchanges between an RWE 204 and an external system 450. As such, various protocol layers necessary for error free and secure communication, and other status, setup, and configuration commands which one might expect in any protocol between two connected systems have been omitted for clarity. Furthermore, some or all of the various commands and responses illustrated could be combined into one or more communication packets without departing from the invention.

Figure 5:
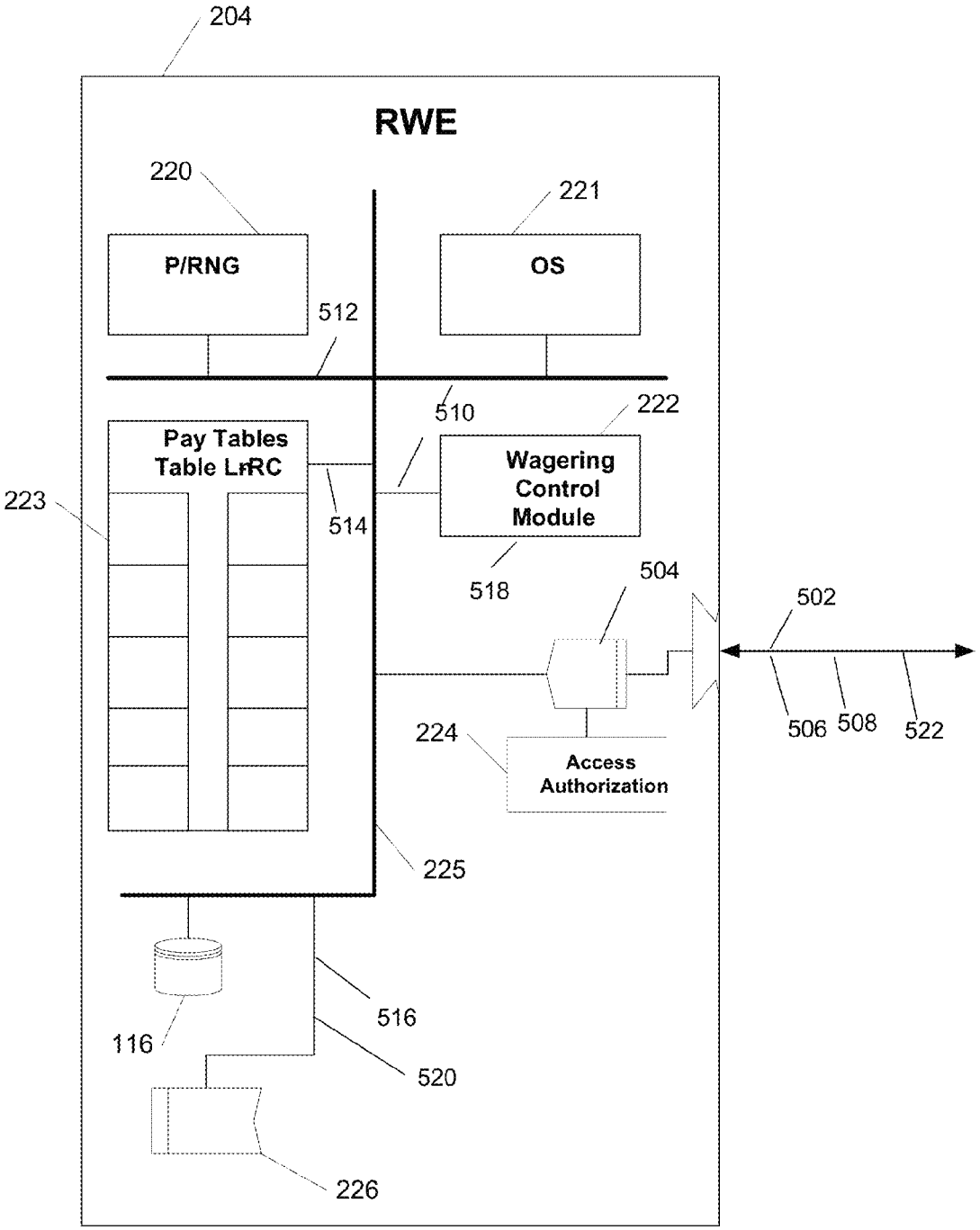
FIG. 5 illustrates a diagram of a process flow and signaling in a Real World Engine (RWE) to provide various functions in accordance with embodiments of the invention.

The process flow for functional communication exchanges, such as communication exchanges described above with reference to FIG. 4, between a RWE and an external system in accordance with embodiments of the invention are shown in FIG. 5. The process begins by a RWE 204 receiving signals from an external system requesting a connection to RWE 204 (502). The Access Authorization Module determines that the external system is authorized to connect to RWE 204 (504) and transmits an authorization response to the external system. The external systems provide a request for a gambling event to be performed to the RWE 294 (506). The request may include an indication of a wager amount on a proposition in the gambling event, and a proper pay table to use to resolve the wager. The external system then sends a signal to trigger the gambling event (508).

The OS 221 instructs the Wager Control Module 222 as to the RC wager and the Pay Table to select as well as to resolve the wager execution (510). In response to the request to execute the gambling event, the wager control module 222 requests an P/RNG result from the P/RNG 220 (512); retrieves a proper pay table or tables from the pay tables 223 (514); adjusts the RC of the player in the RC repository 226 as instructed (516); applies the P/RNG result to the particular pay table or tables (518); and multiplies the resultant factor from the Pay Table by the amount of RC to determine the result of the wager (518). Wager Control Module 222 then adds the amount of RC won by the wager to the RC repository 226 (520); and provides the outcome of the wager, and the amount of RC in the RWE and the RC won (522). One skilled in the art will recognize that there may be many embodiments of an RWE 204 which could be possible, including forms where many modules and components of the RWE are located in various servers and locations, so the foregoing is not meant to be exhaustive or all inclusive, but rather provide information about an RWE 204 in accordance with some embodiments of the invention.

Figure 6:
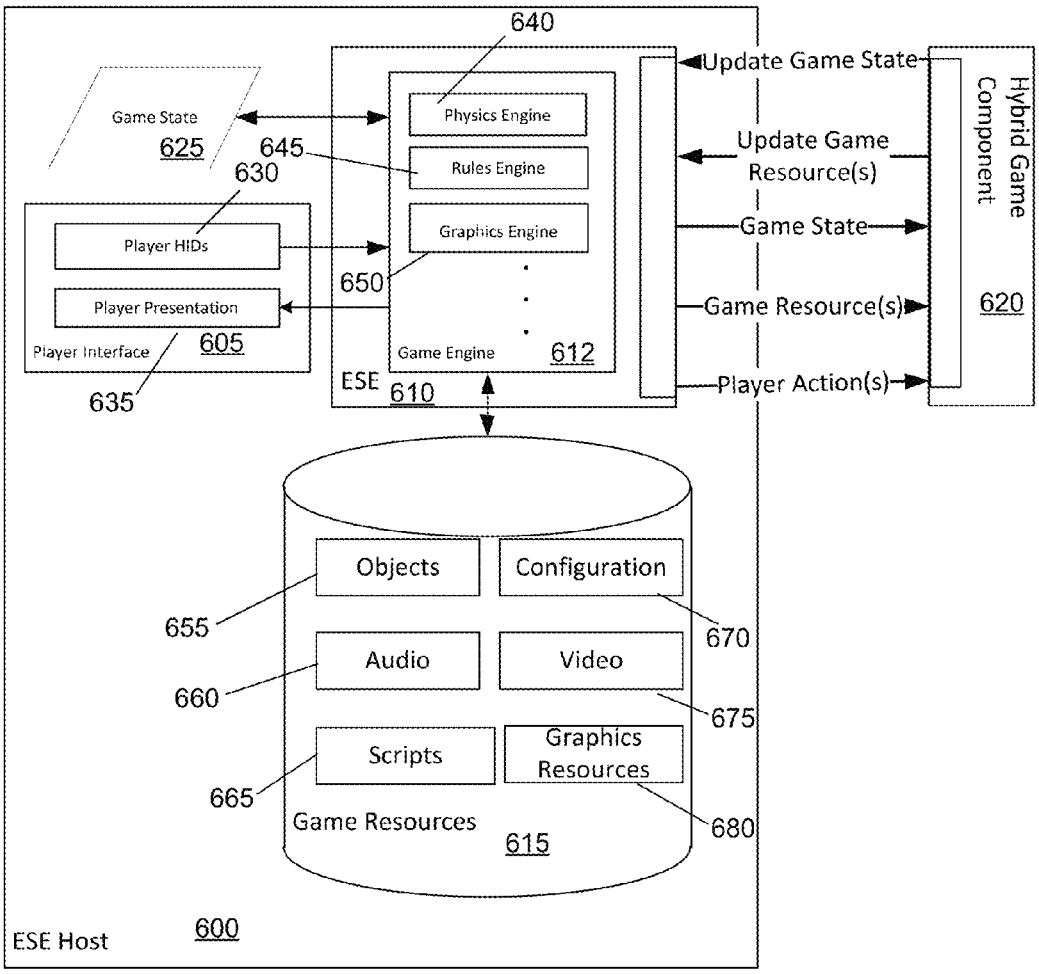
FIG. 6 illustrates a conceptual diagram of aspects of an Entertainment System Engine (ESE) in accordance with embodiments of the invention.

A block diagram of components of an ESE being provided by an ESE host 600 for an intermediate credit hybrid game in accordance with embodiments of the invention is shown in FIG. 6. An ESE 610 may be part of the entertainment game itself, may be a software module that is executed by the entertainment game, or may provide an execution environment for the entertainment game for a particular host. The ESE 610 and associated entertainment game are hosted by an ESE host 600. The ESE host 600 is a computing device that is capable of hosting the ESE 610 and the entertainment game. Exemplary hosts include video game consoles, smart phones, personal computers, tablet computers, or the like. The entertainment game includes a game engine 612 that generates a player interface 605 for interaction with by a player. The player interface includes a player presentation 635 that is presented to a player through the player interface. The player presentation 635 may be audio, visual or tactile, or any combination of such. The player interface 635 further includes one or more Human Input Devices (HIDs) 630 that the player uses to interact with the entertainment game. Various components or sub-engines of the game engine read data from a game state in order to implement the features of the game. Components of the game engine include a physics engine 640 used to simulate physical interactions between virtual objects in the game state, a rules engine 645 for implementing the rules of the game, an P/RNG that may be used for influencing or determining certain variables and/or outcomes to provide a randomizing influence on gameplay, a graphics engine 650 used to generate a visual representation of the game state to the player, an audio engine to generate audio outputs for the player interface, and any other engine needed to provide the entertainment game. The game engine 612 reads and writes game resources 615 stored on a data store of the ESE host. The game resources 615 include game objects 655 having graphics and/or control logic used to implement game world objects of the game engine. The game resources 615 also include video files 675 that are used to generate cut-scenes for the entertainment game. The game resources 615 may also include audio files 660 used to generate music, sound effects, etc. within the entertainment game. The game resources 615 may also include configuration files 670 used to configure the features of the entertainment game. The game resources 615 may also include scripts 665 or other types of control code used to implement various gameplay features of the entertainment game. The game resources 615 may also include graphics resources 680 including, but not limited to, textures, and objects that are used by the game engine to render objects displayed in the entertainment game.

In operation, components of the game engine 612 read portions of the game state 625 and generate the player presentation for the player which is presented to the player using the player interface 605. The player perceives the presentation 635 and provides player inputs using the HIDs 630. The corresponding player inputs are received as player actions or inputs by various components of the game engine 612. The game engine translates the player actions into interactions with the virtual objects of the game world stored in the game state 625. Components of the game engine 612 use the player interactions with the virtual objects of the game and the game state 625 to update the game state 625 and update the presentation 635 presented to the user. The process can loop in a game loop continuously while the player plays the game.

In some embodiments, the ESE 610 is a host running a browser that communicates with a server serving documents in a markup language, such as Hypertext Markup Language 5 (HTML 5) or the like, and the functions of the game engine are performed by the browser on the basis of the markup language found in the documents. In some embodiments, the ESE 610 is a host hosting a specialized software platform, such as Adobe Flash or the like, used to implement games or other types of multimedia presentations, and the functions of the game engine are performed by the specialized platform.

The ESE 610 provides one or more interfaces between an entertainment game and other components 620 of an intermediate credit hybrid game, such as a GWE. The ESE 610 and the other intermediate credit hybrid game component 620 communicate with each other using the interfaces, such as by passing various types of data and sending and receiving messages, status information, commands and the like. Examples of communications include, but are not limited to, requesting by the intermediate credit hybrid game component 620 that the ESE 610 update the game state using information provided by the other component; requesting, by the intermediate credit hybrid game component 620, that the ESE 610 update one or more game resources using information provided by the intermediate credit hybrid game component 620; the ESE 610 providing all or a portion of the game state; the ESE 610 providing one or more of the game resources to the intermediate credit hybrid game component 620; and the ESE 610 communicating player actions to the other intermediate credit hybrid game component 620. The player actions may be low level player interactions with the player interface, such as manipulation of an HID, or may be high level interactions with objects as determined by the entertainment game. The player actions may also include resultant actions such as modifications to the game state or game resources resulting from the player's actions taken in the game. Other examples of player actions include actions taken by entities, such as Non-Player Characters (NPC) of the entertainment game, that act on behalf of, or under the control of, the player.

Elements are a limited resource consumed within an entertainment game to advance entertainment game gameplay. In playing the entertainment game using the elements, a player can (optionally) consume and accrue game world credits (GWC) within the entertainment game. These credits can be in the form of (but are not limited to) game world credits, experience points, or points generally. Wagers can be made in the gambling game as triggered by the player's use of one or more elements of the entertainment game. The wagers are made using real world credits (RC). The real world credits can be credits in an actual currency, or can be credits in a virtual currency which may have a real world value. Gambling outcomes from the gambling game can cause consumption, loss or accrual of RC. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RC value if cashed out of a gameplay session.

Example elements include enabling elements (EE) which are elements that enable a player's play of the entertainment game and whose consumption by the player while playing the entertainment game can trigger a wager in a gambling game. Another non limiting example of an element is a reserve enabling element (REE), which is an element that converts into one or more enabling elements upon occurrence of a release event in skill wagering interleaved game gameplay. Other types of elements include actionable elements (AE) which are elements that are acted upon to trigger a wager in the gambling game and may or may not be restorable during normal play of the entertainment game. Another type of element is a common enabling element (CEE) which as an element that may be shared by two or more players and the use of which by any of the players causes a wager to be triggered.

In progressing through entertainment game gameplay, elements can be utilized by a player during interactions with a controlled entity (CE) which is a character, entity, inanimate object, device or other object under control of a player.

Also, entertainment game gameplay progress and wager triggers can be dependent upon a game world variable such as, but not limited to: a required game object (RGO) which is a specific game object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Although various gameplay resources, such as but not limited to GWC, RC and elements as discussed above, any gameplay resource can be utilized to advance gameplay as well as form the basis for a trigger of a wager as appropriate to the specification of a specific application in accordance with various embodiments of the invention. Various ways in which to operate hybrid games are discussed in PCT Application Nos. PCT/US11/26768, filed Mar. 1, 2011, PCT/US11/63587, filed Dec. 6, 2011, and PCT/US12/50204 filed Aug. 9, 2012, each disclosure of which is hereby incorporated by reference in its entirety.

Figure 7:
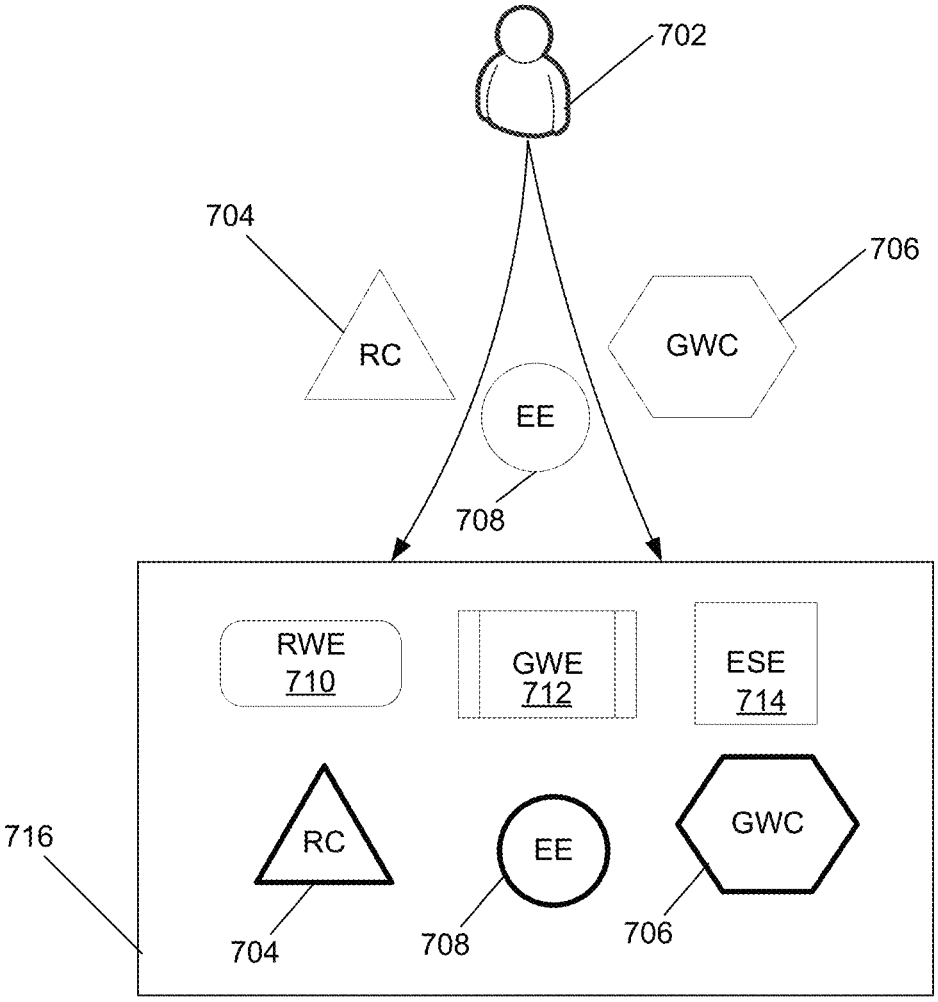
FIG. 7 illustrates a conceptual diagram of interactions between a user and an intermediate credit hybrid game in accordance with embodiments of the invention.

In accordance with some embodiments, a player can interact with an intermediate credit hybrid game by using RC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RC and elements, such as but not limited to enabling elements (EE), are utilized in an intermediate credit hybrid game in accordance with an embodiment of the invention is illustrated in FIG. 7. The conceptual diagram illustrates that RC 704, EE 708 and GWC 706 can be utilized by a player 702 in interactions with the RWE 710, GWE 712 and ESE 714 of an intermediate credit hybrid game 716. The contribution of elements, such as EE 708, can be linked to a player's access to credits, such as RC 704 or GWC 706. Electronic receipt of these credits can come via a smart card, voucher or other portable media, or as received over a network from a server. In accordance with certain embodiments, these credits can be drawn on demand from a player profile located in a database locally on an intermediate credit hybrid game or in a remote server.

Figure 8:
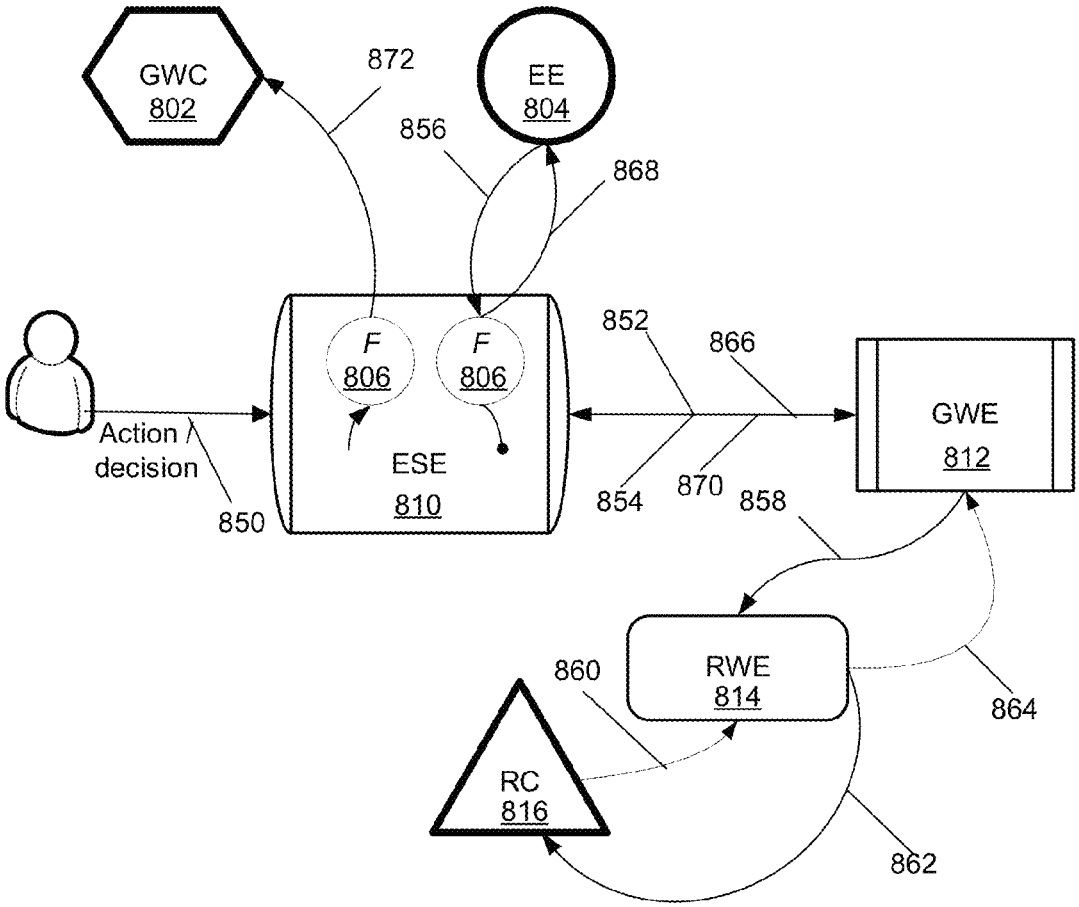
FIG. 8 illustrates a conceptual diagram of the interplay between aspects of an intermediate credit hybrid game in accordance with some embodiments of the invention using Real World Currency (RC).

A conceptual diagram that illustrates the interplay between aspects of an intermediate credit hybrid game in accordance with an embodiment of the invention using real world credit (RC) is illustrated in FIG. 8. Similar to FIG. 7, a player's actions and/or decisions can affect functions 806 that consume and/or accumulate GWC 802 and/or EE 804 in an entertainment game executed by an ESE 810. A GWE 812 can monitor the activities taking place within an entertainment game executed by an ESE 810 for gameplay gambling event occurrences. The GWE 812 can also communicate the gameplay gambling event occurrences to an RWE 814 that triggers a wager of RC 816 in a gambling game executed by the RWE 814.

In accordance with some embodiments of the invention, the following may occur during use of the intermediate credit hybrid game. The user enters an input that represents an action or decision (850). The ESE 810 signals the GWE 812 with the input decision or action (852). The GWE 812 responds by signaling to ESE 810 with the amount of EE that is consumed by the player action or decision (854). The signaling from the GWE 812 configures a function 806 to control the EE consumption, decay, and/or accumulation.

The ESE 810 then adjusts the EE 804 accordingly (856). The GWE 812 signals the RWE 814 as to the profile of the wager proposition associated with the action or decision and triggers the wager (858). The RWE 814 consumes the appropriate amount of RC 816 and executes the wager (860). The RWE 814 then adjusts the RC 816 based upon the outcome of the wager (862) and informs the GWE 812 as to the outcome of the wager (864).

The GWE 812 signals the ESE 810 to adjust EE to one or more of the EEs of the ESE entertainment game (866). Function 806 of the ESE 810 performs the adjustment of EE 804 (868). The ESE 810 signals the GWE 812 as to the updated status (870). In response, the GWE 812 signals the ESE 810 to update GWC of the entertainment game. The ESE updates the GWC 802 using a function 806 (872).

The following is an example of the above flow in a first person shooter game, such a Call of Duty®, using an intermediate credit hybrid game sequence in accordance with embodiments of the invention.

The process begins by a player selecting a machine gun to use in the game and then fires a burst of bullets at an opponent (850). The ESE 810 signals the GWE 812 of the player's choice of weapon, that a burst of bullets was fired, and the outcome of the burst (852). GWE 812 processes the information received and signals ESE 810 to consume 3 bullets (EE) with each pull of the trigger (854). The ESE 810 consumes 3 bullets for the burst using function 806 (856).

The GWE 812 signals the RWE 814 that 3 credits (RC) are to be wagered to match the three bullets consumed. The RWE 814 then determines the result of the wager and may determine the winnings from a pay table. On a particular pay table (Table Ln-RC), a determination is made by RWE 814 as to the amount of damage that the opponent has sustained. The RWE 814 consumes 3 credits of RC 816 for the wager and executes the specified wager (860). The RWE 814 determines that the player hit a jackpot of 6 credits and returns the 6 credits to the RC 816 (862) and signals the GWE 812 that 3 net credits were won by the player (864).

The GWE 812 signals ESE 810 to add 3 bullets to an ammunition clip (866). ESE 810 adds 3 bullets back to the ammo clip (EE 804) using a function 806 (868). The ammunition may be added by directly adding the ammunition to the clip or by allowing the user to find extra ammunition during gameplay. The GWE 812 logs the new player score (GWC 802) in the game (as a function of the successful hit on the opponent) based on the ESE 810 signaling, and the signals the ESE 810 to add 2 extra points to the player score since a jackpot has been won (870). The ESE 810 then adds 10 points to the player score (GWC 802) given the success of the hit which in this example is worth 8 points, plus the 2 extra points requested by GWE 812 (872). Note that the foregoing example is only intended to provide an illustration of how credits flow in an intermediate credit hybrid game, but is not intended to be exhaustive and only lists only one of numerous possibilities of how an intermediate credit hybrid game may be configured to manage its fundamental credits.

Figure 9:
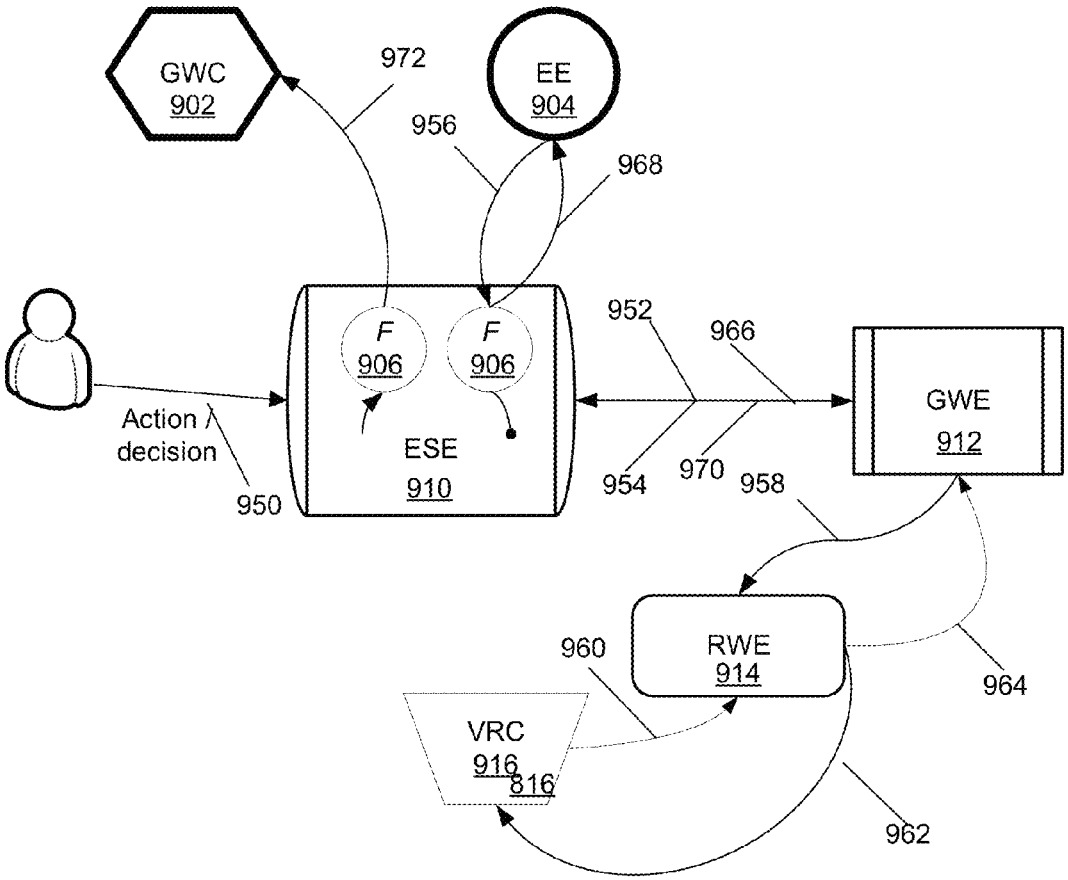
FIG. 9 illustrates a conceptual diagram of the interplay between aspects of an intermediate credit hybrid game in accordance with other embodiments of the invention using Virtual Real World Currency (VRC).

A conceptual diagram that illustrates the interplay between aspects of an intermediate credit hybrid game in accordance with an embodiment of the invention using virtual real world credit (VRC) is illustrated in FIG. 9. As seen in the FIG. 9, substituting VRC in place of RC is effected without impact to the architecture or operation of the intermediate credit hybrid game. The implementation of FIG. 9 is not the only embodiment using virtual currency within an intermediate credit hybrid game, but shows only one permutation of which many could exist.

Similar to FIG. 8, a player's actions and/or decisions can affect functions 906 that consume and/or accumulate GWC 902 and/or EE 904 in an entertainment game executed by an ESE 910 in the process shown in FIG. 9. A GWE 912 can monitor the activities taking place within an entertainment game executed by an ESE 910 for gameplay gambling event occurrences. The GWE 912 can also communicate the gameplay gambling event occurrences to a RWE 914. Unlike the process shown in FIG. 8, RWE 914 triggers a wager of virtual real world credit (VRC) 916 in a gambling game executed by the RWE 914.

For purposes of this discussion, VRC can be thought of as a form of alternate currency, which can be acquired, purchased or transferred, in unit or in bulk, by/to a player, but does not necessarily directly correlate to RC or real currency. As an example, there is a virtual currency called "Triax Jacks", 1000 units of which are given to a player by an operator of an intermediate credit hybrid game, with additional blocks of 1000 units being available for purchase for $5 USD each block. Triax Jacks could be redeemed for various prizes, or could never be redeemed but simply used and traded purely for entertainment value by players. It would be completely consistent with the architecture of the intermediate credit hybrid game that Triax Jacks would be wagered in place of RC, such that the intermediate credit hybrid game could be played for free, or with played with operator sponsored Triax Jacks.

Returning to the process in FIG. 9, the following may occur during use of the intermediate credit hybrid game in accordance with embodiments of the invention. The user enters an input that represents an action or decision (950). The ESE 910 signals the GWE 912 with the input decision or action (952). The GWE 912 responds by signaling to ESE 910 with the amount of EE that is consumed by the player action or decision (954). The signaling from the GWE 912 configures a function 906 to control the EE consumption, decay, and/or accumulation.

The ESE 910 then adjusts the EE 904 accordingly (956). The GWE 912 signals the RWE 914 as to the profile of the wager proposition associated with the action or decision and triggers the wager (958). The RWE 914 consumes the appropriate amount of RC 916 and executes the wager (960). The RWE 914 then adjusts the RC 916 based upon the outcome of the wager (962) and informs the GWE 912 as to the outcome of the wager (964).

The GWE 912 signals the ESE 910 to adjust EE to one or more of the EEs of the ESE entertainment game (966). Function 906 of the ESE 910 performs the adjustment of EE 904 (968). The ESE 910 signals the GWE 912 as to the updated status (970). In response, the GWE 912 signals the ESE 910 to update GWC 902 of the entertainment game. The ESE updates the GWC 902 using a function 906 (972).

Network Based Intermediate Credit Hybrid Game

Figure 10:
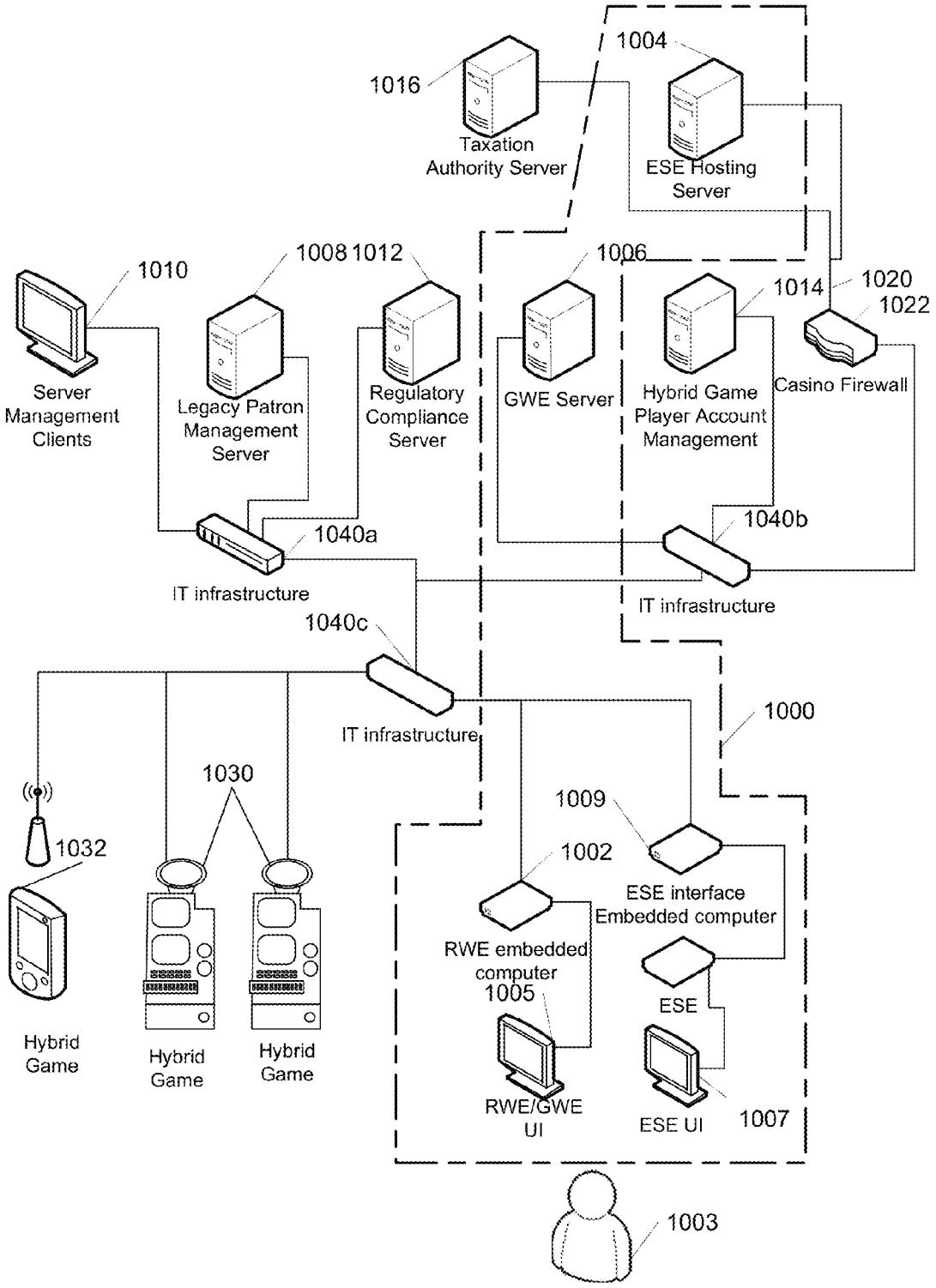
FIG. 10 illustrates a system diagram of an implementation of a network based intermediate credit hybrid game in accordance with another embodiment of the invention.

A system diagram that illustrates an implementation of a network distributed intermediate credit hybrid game with a GWE local server in accordance with embodiments of the invention is illustrated in FIG. 10. In the figure, the intermediate credit hybrid game 1000 includes components, RWE 1002 embedded in a device used as the user interface for player 1003. The device provides both a RWE/GWE user interface 1005 and an ESE user interface 1007 for the player. The ESE is provisioned by an ESE hosting server 1004 via ESE interface 1009, and the GWE is provisioned by GWE server 1006 as indicated by the dashed line. Also pictured in the diagram are a number of other peripheral systems, such as player management 1008, casino management 1010, regulatory 1012, hybrid game player account management 1014, and taxation authority 1016 hosting servers that may be present in such an implementation. FIG. 10 also illustrates various other systems, which may reside outside the bounds of the casino and are connected to the framework via communications network, such as the Internet 1020, depicted by the connection lines past the casino firewall 1022. The end devices utilized for user interfaces for an intermediate credit hybrid game include, but are not limited to, casino electronic game machines 1030 and wireless or portable devices, such as smart phone 1032, personal digital assistants, tablet computers, video gaming consoles or the like. These disparate devices are connected within and without the casino through the casino's information technology structure as illustrated by routers 1040*a*, 1040*b* and 1040*c*. It should be understood that FIG. 10 does not attempt to illustrate all servers and systems to which an intermediate credit hybrid game 1000 might be inevitably be connected, and indeed one might expect there would be others, but rather provides an example of a set of a sub-set of systems which would be present in an exemplary embodiment of an installation.

Figure 11:
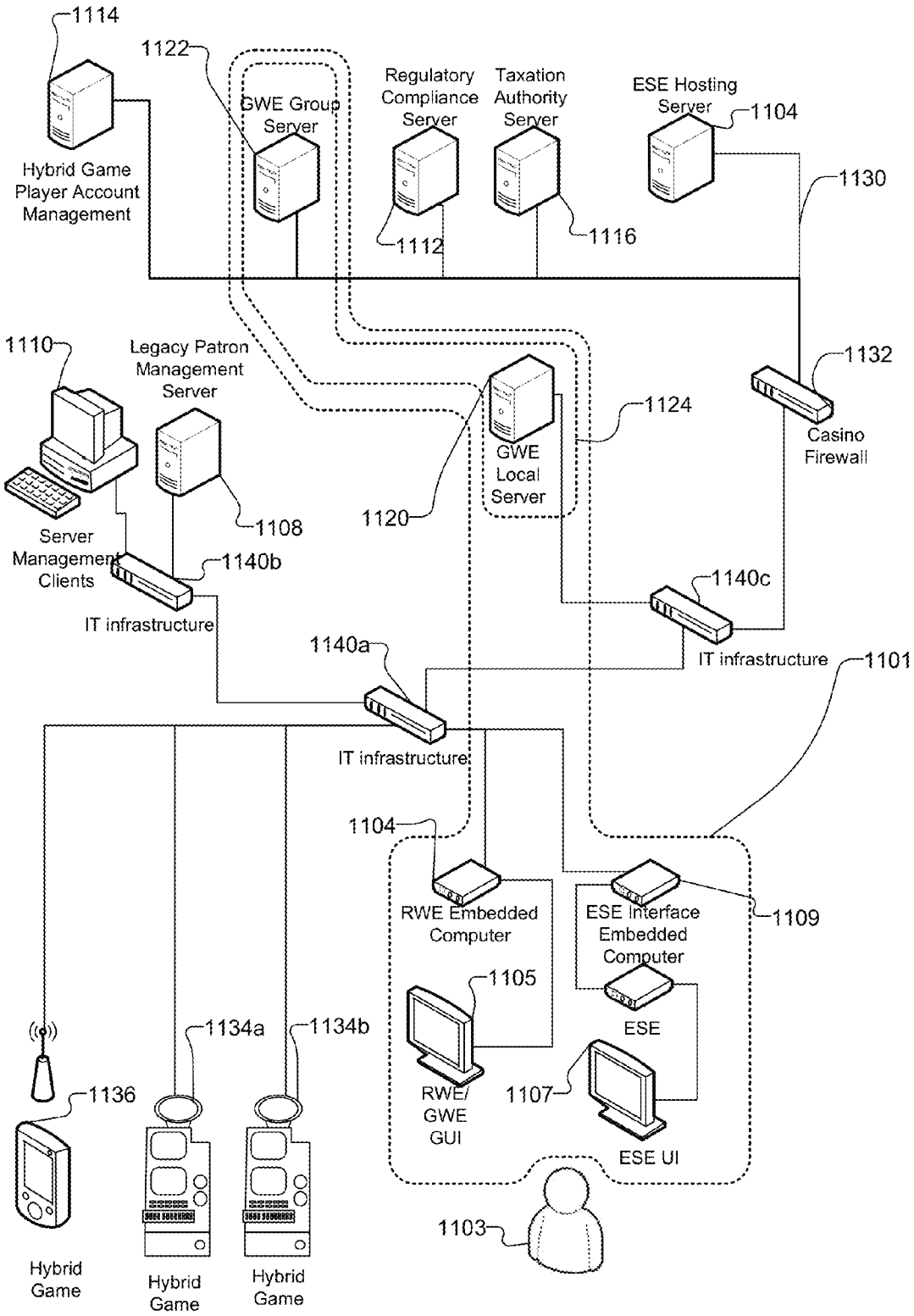
FIG. 11 illustrates a system diagram of an implementation of an Internet based intermediate credit hybrid game in accordance with an embodiment of the invention.

FIG. 11 is a diagram showing another implementation of an intermediate credit hybrid game in accordance with an exemplary embodiment. In the figure, the intermediate credit hybrid game 1101 includes components, RWE 1104 embedded in a device used as the user interface for player 1103. The device provides both a RWE/GWE user interface 1105 and an ESE user interface 1007 for the player. The ESE is provisioned by an ESE hosting server 1104 via ESE interface 1109. Also pictured in the diagram are a number of other peripheral systems, such as player management 1108, casino management 1110, regulatory 1112, hybrid game player account management 1114, and taxation authority 1116 hosting servers that may be present in such an implementation. In the figure, note that the GWE is composed of two sub-components, a local GWE server 1120, and a cloud server 1122 (components within the dash line area 1124). In the figure, certain of the components are located within the bounds of the casino, namely the RWE, the ESE and a portion of the GWE, namely the local GWE server 1120. The Cloud Server GWE 1122 is located in the cloud connected to the casino bounded intermediate credit hybrid game components via communications network such as the Internet 1130 through a firewall 1132. FIG. 11 also illustrates various other systems, which may reside outside the bounds of the casino and are connected to the framework via communications network. The end devices utilized for user interfaces for an intermediate credit hybrid game include, but are not limited to, casino electronic game machines, 1134*a* and 1134*b*, and wireless or portable devices, such as smart phone 1136, personal digital assistants, tablet computers, video gaming consoles or the like. These disparate devices are connected within and without the casino through the casino's information technology structure as illustrated by routers 1140*a*, 1140*b* and 1140*c*. It should be understood that FIG. 11 does not attempt to illustrate all servers and systems to which an intermediate credit hybrid game might be inevitably be connected, and indeed one might expect there would be others, but rather provides an example of a set of a sub-set of systems which would be present in an exemplary embodiment of an installation.

Figure 12:
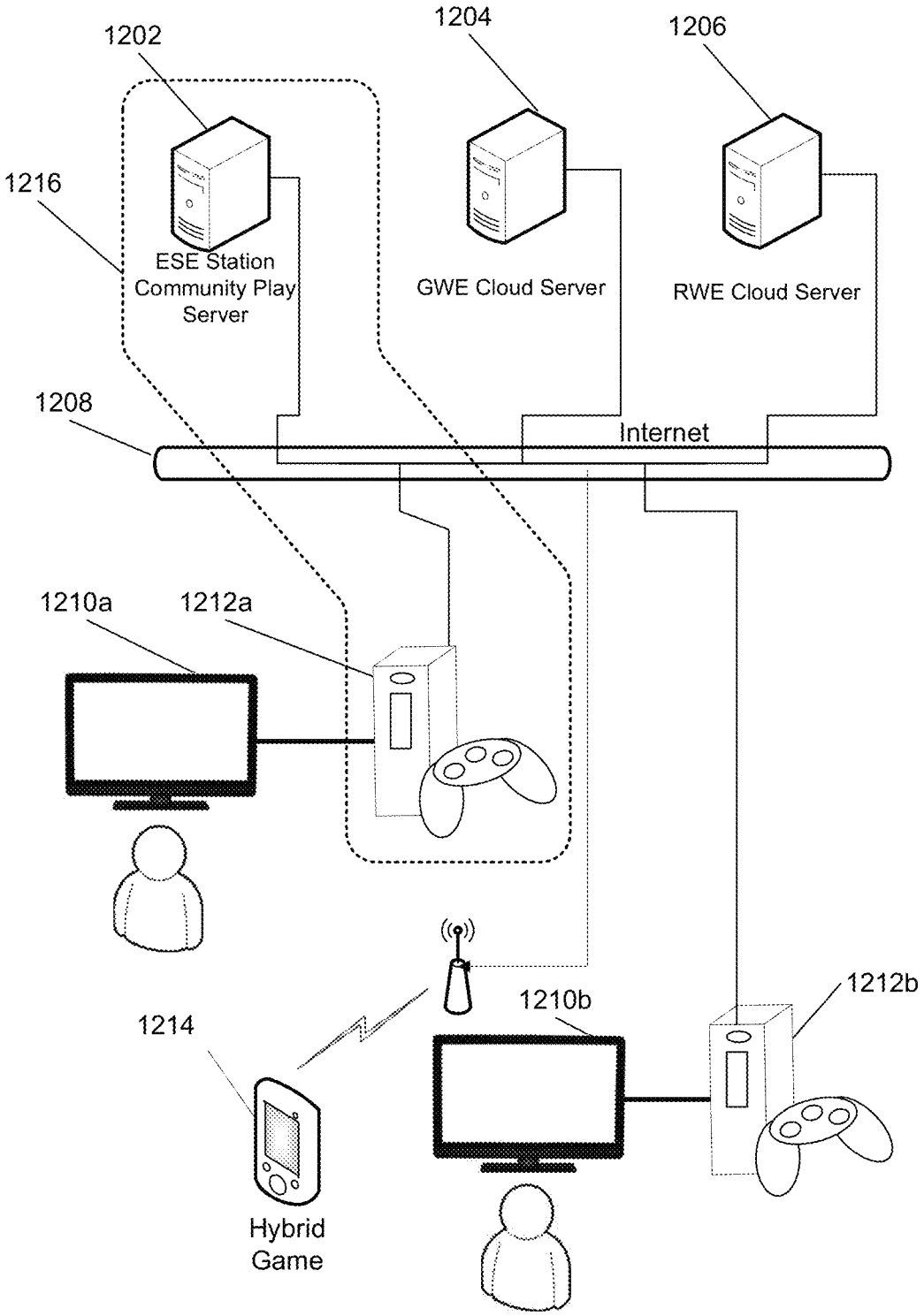
FIG. 12 illustrates a system diagram of an implementation of a cloud based intermediate credit hybrid game in accordance with an embodiment of the invention.

A system diagram that illustrates an implementation of network a cloud based intermediate credit hybrid game over the Internet in accordance with an embodiment of the invention is illustrated in FIG. 12. The system includes an ESE server 1202, GWE server 1204 and RWE server 1206 that each connect to a user interface, 1210*a* or 1210*b*, (such as, but not limited to, a television screen, computer terminal, tablet, touchscreen or PDA) of intermediate credit hybrid games over the Internet 1208. Each intermediate credit hybrid game includes a local ESE 1212*a* or 1212*b* (such as, but not limited to, a video game console or a gaming computer system) that interfaces with a remote ESE server 1002. Processes performed by an ESE 1212*a* services can be performed in multiple locations, such as, but not limited to, remotely on an ESE server 1202 and locally on a local ESE 1212*a*. In addition, an intermediate credit hybrid game may include a Personal Digital Assistant (PDA) 1214 or other type of mobile computing device game coupled to the ESE hosting server 1202, thus providing the opportunity for a player to play an intermediate credit hybrid game on the PDA through a mobile phone or data network.

There are many possible permutations of how an intermediate credit hybrid game could be constructed, with FIGS. 10, 11 and 12 showing only three possible permutations and provided as examples, which are not intended to suggest limitations to the forms of the architecture. Other embodiments include a version where the entire intermediate credit hybrid game is in the cloud with only a client running on player terminal within the bounds of the casino, or a version where the RWE and GWE are casino bound and the ESE exists in the cloud, accessed by a client running on a terminal in the casino.

Processing Apparatuses

Figure 13:
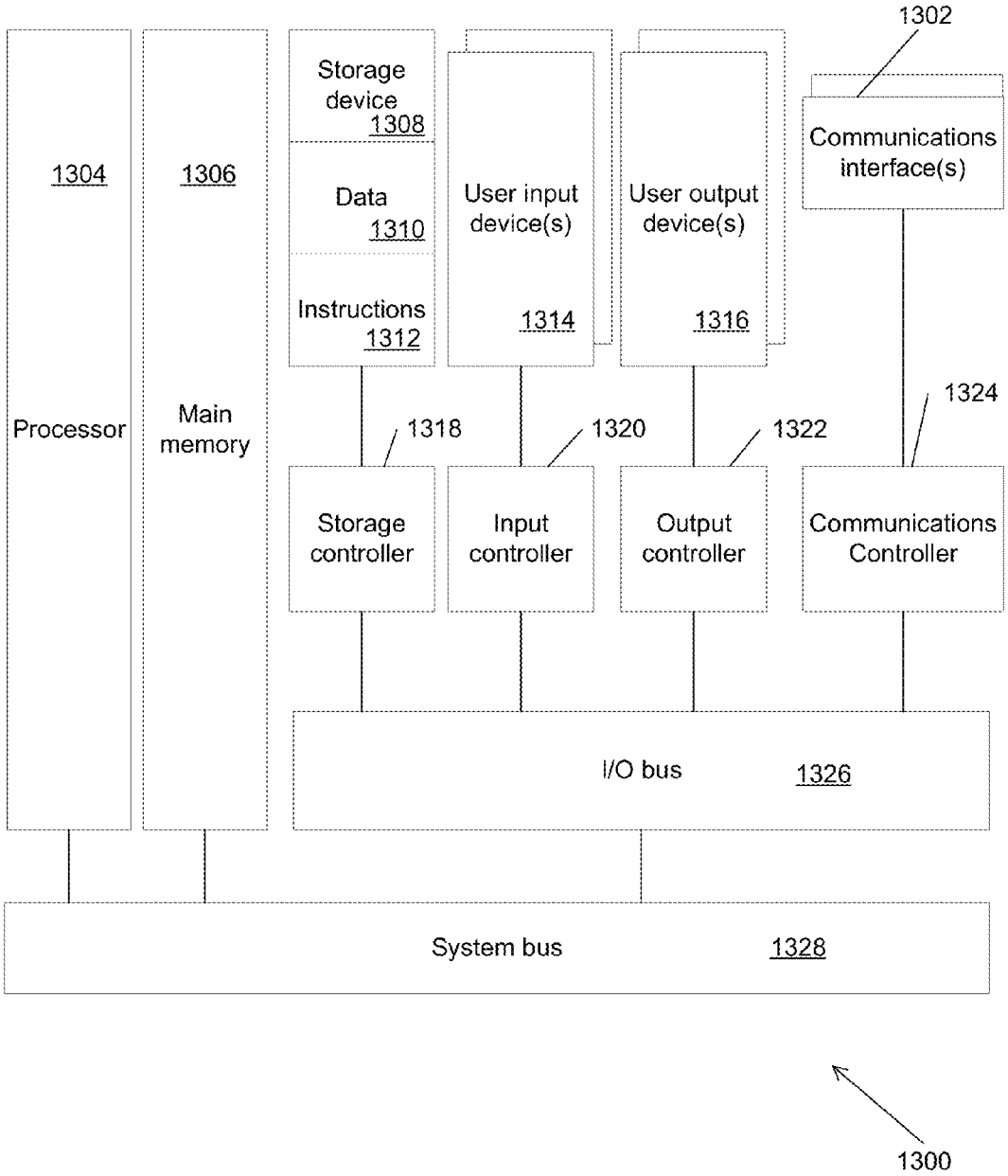
FIG. 13 illustrates a block diagram of components of a device implementing an intermediate credit hybrid game in accordance with an embodiment of the invention.

Any of a variety of processing apparatuses can host various components of an intermediate credit hybrid game in accordance with embodiments of the invention. In accordance with embodiments of the invention, these processing apparatuses can include, but are not limited to, a server, a client, a mobile device such as a smartphone, a personal digital assistant or the like, a wireless device such as a tablet computer or the like, an electronic gaming machine, a general purpose computer, a gaming console, a computing device and/or a controller. A processing apparatus that is constructed to implement an intermediate credit hybrid game in accordance with embodiments of the invention is illustrated in FIG. 13. In the processing apparatus 1300, a processor 1304 is coupled to memory 1306 by a bus 1328. The processor 1304 is also coupled to non-transitory machine-readable storage media, such as a storage device 1308 that stores executable instructions 1312 and data 1310 through the system bus 1328 to an I/O bus 1326 through a storage controller 1318. The processor 1304 is also coupled to one or more interfaces that can be used to connect the processor to other processing apparatuses as well as networks as described herein. The processor 1304 is also coupled via the bus to user input devices 1314, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 1304 is connected to these user input devices 1314 through the system bus 1328, to the I/O bus 1326 and through the input controller 1320. The processor 1304 is also coupled via the bus to user output devices 1316 such as (but not limited to) visual output devices, audio output devices, and/or tactile output devices that the processing apparatus uses to generate outputs perceivable by the user when the user interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 1304 is coupled to tactile output devices like vibrators, and/or manipulators. The processor 1304 is connected to output devices from the system bus 1328 to the I/O bus 1326 and through the output controller 1322. The processor 1304 can also be connected to a communications interface 1302 from the system bus 1328 to the I/O bus 1326 through a communications controller 1324.

In accordance with various embodiments, a processor 1304 can load instructions and data from the storage device into the memory 1306. The processor 1304 can also execute instructions that operate on the data to implement various aspects and features of the components of an intermediate credit hybrid game. The processor 1304 can utilize various input and output devices in accordance with the instructions and the data in order to create and operate user interfaces for players or operators of an intermediate credit hybrid game (such as but not limited to a casino that hosts the intermediate credit hybrid game).

Although the processing apparatus 1300 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 1304 through one of the interfaces or over a network. Furthermore, any of the user input devices or user output devices can be coupled to the processor 1304 via one of the interfaces or over a network. In addition, although a single processor 1304 is described, those skilled in the art will understand that the processor 1304 can be a controller or other computing device or a separate computer as well as be composed of multiple processors or computing devices including one or more processors.

Operation of an Intermediate Credit Hybrid Game

An intermediate credit hybrid game awards entertainment game resources to a player based on results of a wagering proposition of real world credits in a gambling game. The intermediate credit may also be awarded to a player based on an outcome in the entertainment game. An example of such an entertainment game resource is quanta, where quanta is an intermediate in-game player resource, which may be used to purchase or enable additional in game resources, such as, but not limited to, in-game elements such as EE or the like, which may change the state of the entertainment or skill based game and/or offer the player benefits or advantages in the entertainment or skill based game. Elements that are enabled through the use of quanta are herein termed quanta enabled elements (QEE). In particular, quanta enabled enabling elements (QEEE) are enabling elements that may be accessed through the use of quanta. When the QEEE are utilized by a player, a wager is triggered in a gambling game. quanta is awarded to the player as a result of the outcome of wagers made to the RWE. In some embodiments, quanta is awarded on the basis of an outcome in the entertainment game. Typically a winning wager may result in quanta being added, where as a losing result or push may not result in quanta being added. While this is a typical case, this may not be the case in all instances. The process of awarding quanta in-game, may vary from game to game and/or from operator to operator.

Figure 14:
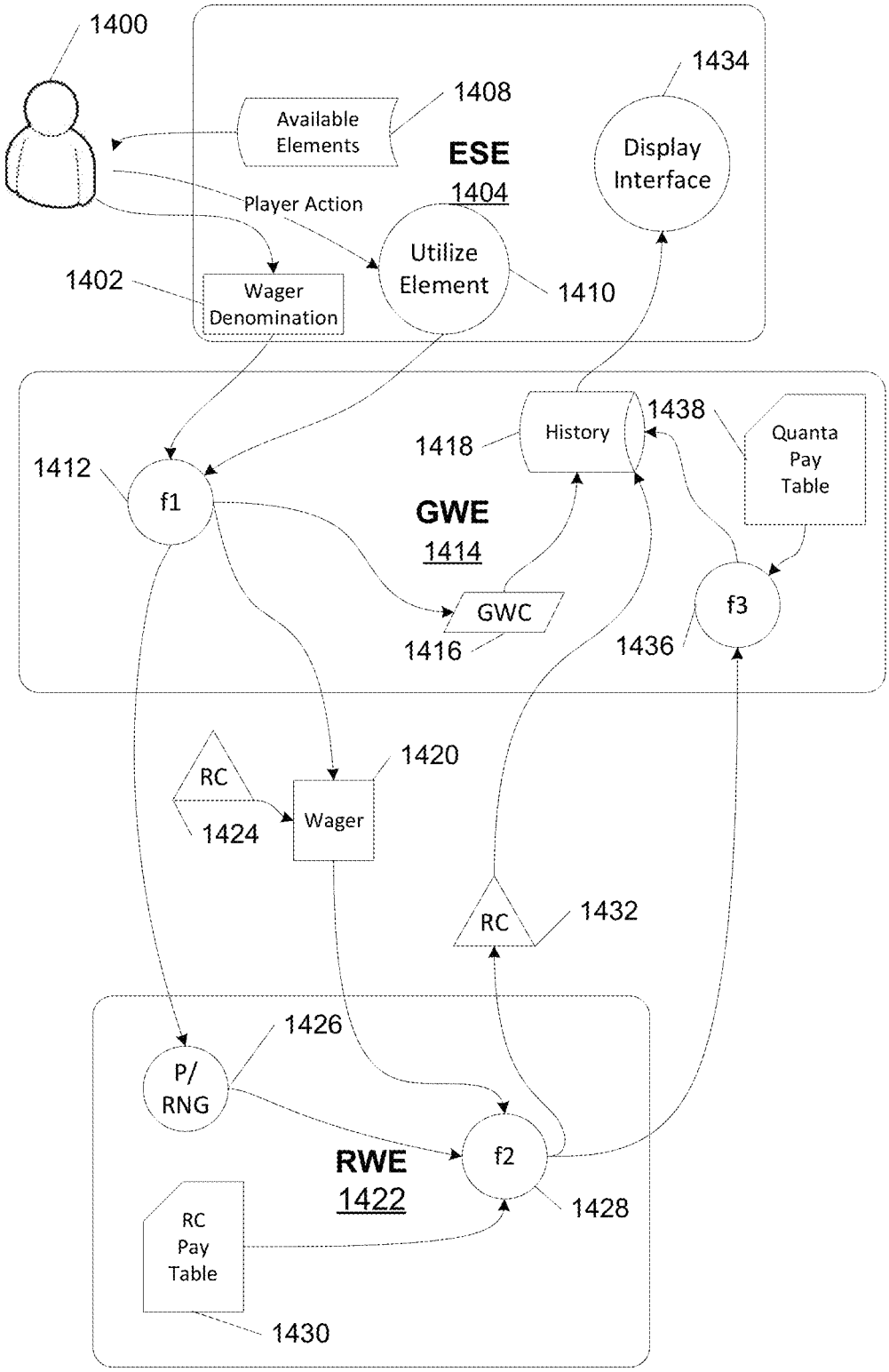
FIG. 14 is a flow diagram of an intermediate resource hybrid game in accordance with an embodiment of the invention.

FIG. 14 is a flow diagram of an intermediate resource hybrid game in accordance with an embodiment of the invention. As illustrated in FIG. 14, a player 1400 may select the wager denomination 1402 they wish to play in an intermediate resource hybrid game. Once play of the entertainment game commences, the player may receive information from the ESE 1404, regarding available elements 1408 for utilization by the player. The player may instruct the ESE by choosing an element, such as an EE or the like, they wish to utilize during the player's skillful play of an entertainment game that is being executed by the ESE 1404. When the player utilizes (1410) the element, player commits to a gambling proposition, the parameters of which may be a function of f1 1412 in the GWE 1414. Function f1 may include the following processes:

- Award GWC 1416 based on an outcome of the entertainment game that was a result of the player's utilization of the element in the entertainment game;
- Trigger a wager 1420 in the RWE 1422;
- Generate the GWC 1716, which would then be summed with the existing GWC and updated in the game world credit history 1418;
- Determine the amount of real credits (RC) 1724 to be wagered, based upon inputs which may include type of element utilized by the player in the entertainment game (for example if an extra turn is played, using QEEE, a wager may be required for each turn played) and wager denomination selected by the player. For example a player opts to gamble $0.02 per torpedo, and the player launces two torpedoes in a turn, this may result in two $0.02 wagers, or a single wager of $0.04. This is shown as an example, other formulae could be used, depending on casino, regulatory or other input or requirements; and Trigger the pseudo random or random number generator (P/RNG)/gambling 1426, in the RWE 1422.

In various embodiments, the RWE 1422 may contain a function f2 1428. f2 1428 may take as inputs, the amount of RC bet 1424, or the wager, the result of the P/RNG 1426, and a pay table 1430. Based on the P/RNG result and pay table look-up, and amount of RC wagered, f2 computes the amount of RC 1432, if any, won by the player. RC won is fed back to the game world credit history 1418 in the GWE 1414, and is displayed to the player 1400, via the ESE 1404 display interface 1434.

In some embodiments, the game world credit history includes RC or quanta won or lost, RC meter values, quanta available, etc. A quanta selector user interface etc. may be presented as an overlay on the ESE's display interface.

In many embodiments, function f3 1436, which resides in the GWE 1414, includes a process to determine how much if any quanta is to be awarded based on the outcome of the gambling proposition. The output of f2 1428, and it's inputs, including wager 1420, P/RNG result 1426, RC pay table 1430, and the quanta pay table 1438, may also serve as inputs to f3. How much, if any, quanta is generated by f3 may vary significantly, based upon factors such as desired player experience, game personality desired, including how much influence the outcome of the gambling game may have on the entertainment or skill based game. In some embodiments the amount of quanta generated may be inversely proportional to the gambling result, potentially allowing a player who is doing poorly in the gambling game to gain advantage in the entertainment or skill game. The quanta generated by f3, will be summed with existing quanta and stored with the game world credit history 1418, pending it's future use, by the player. The amount of quanta available, along with a display of items that may be purchased with the quanta is displayed to the player, via the display interface 1434 in the ESE.

In various embodiments the game world credit history will pass information including, but not limited to, the state of the game board or field of play, current score (GWC) opponents current score, quanta available, quanta enabled enabling elements (QEEE) available, wager denomination, and current RC balance, which may be displayed to the player, via the display interface 1434.

In some embodiments, an intermediate credit hybrid game may have multiple types of an intermediate currency, also termed quanta, as opposed to a singular type. For example, a player can have their own quanta pool, born of their own in-game gambling activities, but there can also be a pool of a second type of quanta (which may or may not be fungible with the first type) that is born of communal actions and community driven bets. The second type of quanta may or may not be able to be drawn down by individuals or it may require group consensus or specialized "agreements" to be reached and/or cooperative acts to be brought into play. For example, in a game of military strategy, it may be required that a majority of players on a given team (who each represent the heads of one armed force, i.e. air force, navy, army) to agree what "R&D" the quanta is to be expended upon, or to which player or players it is to be transferred for them to use as part of the aspect of game play that they individually direct (e.g. movements of a specific army). It is possible that certain types of research or other quanta expenditures may benefit more than one player.

Additionally, in some embodiments, a system with multiple types of quanta may allow a "quanta skim" in which the winning team gets a share of the quanta that was expended during the course of the game. For example, in a racing game, each player expends quanta throughout the game—with each player spending quanta in whatever way they chose. A percentage of the total quanta is added to a "pot" for the end of the game. Then whoever comes in first is awarded 60% of the quanta, second place receives 25% of the quanta, etc. In a system where N is the total quanta spent by the players, and X is a percentage that the house receives, N−N*X may be raked off for an aggregation of quanta in a prize pool.

In another embodiment, multiple types of quanta may be tracked to allow parallel tournament entries. A player may gain access to a tournament through GWC, total quanta, specific quanta types, or some combination of those and other Hybrid Game factors.

Figure 15:
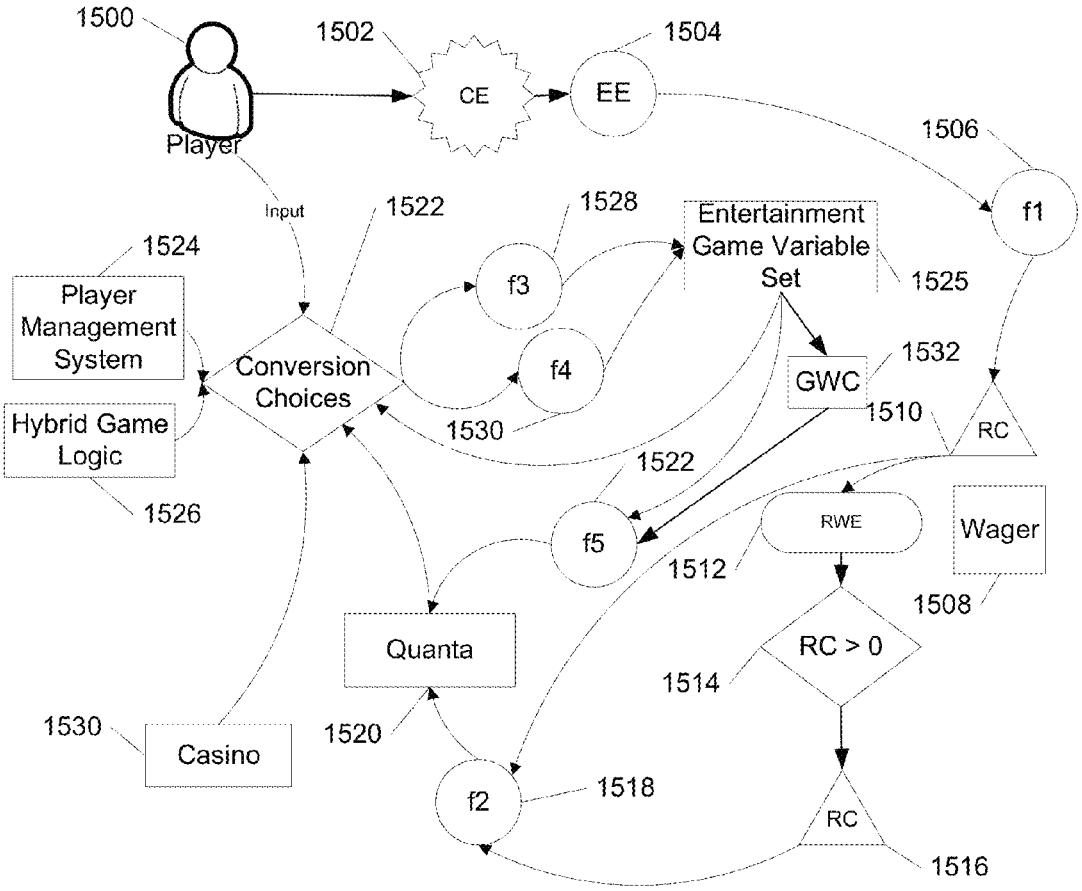
FIG. 15 is another flow diagram of an intermediate resource hybrid game in accordance with an embodiment of the invention.

FIG. 15 is another flow diagram of an intermediate resource hybrid game in accordance with an embodiment of the invention. As illustrated in FIG. 15, a player 1500 takes actions in an entertainment game that is part of an intermediate credit hybrid game. In many embodiments, the entertainment game is executed by an ESE (not shown). In some embodiments, the player's actions are taken using a controlled entity (CE) 1502. The player actions include utilization of an element, such as enabling element 1504. The utilization of the element triggers (as indicated by function f1 1506), a wager 1508 of real credit 1510 in a gambling game of the intermediate resource hybrid game. In many embodiments, the function f1 1506 is a process within a GWE (not shown). The wager is executed by an RWE 1512, resulting in a gambling game outcome. In response to the gambling outcome, the GWE generates quanta 1520. In many embodiments, an amount of quanta is generated based on a gambling outcome that is favorable to the player, such as winning (1514) an amount of real world credit 1516 as indicated by function f2 1518. In addition, quanta may be generated based on an amount of real world credit 1510 committed to the wager. Once the quanta is generated, a player may select various items and uses for the quanta in a conversion process. The actual selection may be influenced by a variety of factors and inputs. These factors include, but are not limited to, quanta conversion rules or functions, as indicated by functions f3 1528 and f4 1530, provided by a casino 1530 or other operator of the intermediate credit hybrid game, by the logic 1526 of the intermediate credit hybrid game, by a patron management system 1524, and by an entertainment game variable set 1525. Accordingly, a result of the gambling game, rather than being converted directly into the same element that initiated the wager in the first place (e.g. EE, AE, CEE) is converted into an intermediate quantity of quanta according to a formula or formulae embedded in f2. The quanta, which may or may not be observable to the player as part of hybrid game play, is ultimately converted into one or more elements (including but not limited to EE, AE, CEE, in-game objects, in-game currency, CEC, REC, CE attributes, etc.) in use within the entertainment game portion of the hybrid game. In some embodiments, quanta can also in some instances, though it need not be, be converted into RC, GWC, universal GWC, etc.

Quanta is converted into one or more of these downstream elements as a function of, but not limited to, one or more inputs and factors as described herein (though the choice of conversion is not limited solely to these drivers). The logic by which quanta is converted may be established at the onset of game play, in real time during game play, or at other times as dictated by the hybrid game, possibly as a function of casino input or other inputs: conversion choices affected by the player; casino choices (which may be temporal or permanent in nature or a combination thereof); variables within the entertainment game; variables within the player profile; GWE software hybrid game logic—which may or may not also take into account the entertainment game state, and/or other variables.

In FIG. 15, the selected conversion(s) are affected by functions f3 1528 and f4 1530. In some embodiments, a separate function may exist for each downstream variable or element into which quanta can be converted, or a more integrated function, subsuming multiple conversions, may be deployed, such that f3 and f4 (and/or additional functions as may exist) are replaced by a lesser number of more substantive functions of greater expanse.

In many embodiments, the conversion of quanta into a specific element or variable can be (a) affected at any time at the behest of a player and/or casino and/or the hybrid game logic itself as resident within the GWE, and/or (b) at specific times as dictated by game play and/or Hybrid Game logic, and/or casino and/or regulatory restrictions/rules or other inputs, etc. The point is that the conversion of quanta may be "latched" in so far as it may or may not be able to be undertaken at all times.

In several embodiments, the GWE of the intermediate credit hybrid game can also include functionality by which quanta are conserved across more than one game session, or quanta can only persist within a single game session. Quanta, like GWC in this regard, can also be subject to exchange across various games and/or domains. Alternately, a universal quanta can be deployed, or a standardized quanta system (analogous to GWC standardization across multiple game platforms) can be deployed to make quanta fungible across multiple game platforms and/or domains (e.g. casino property groups).

In some embodiments, quanta can be accumulated not just as a function of gambling game wins, but also as a function of GWC 1532. More generally, quanta can be accumulated as a function of any entertainment game variable. Function f5 1522 represents one or more formulae that convert GWC into an amount of quanta. In the more general case, the function f5 1522 can take in one or more entertainment game variables, inclusive of GWC.

In some embodiments, functions f2 1518 and f5 1522 can be replaced by a single function or set of functions (f2 for purposes of this diagram) that take RC and GWC as arguments, the amount of quanta resulting be a function of the relationship between the two.

In some embodiments, f5 1522 contains one or more processes that would convert a change in GWC into quanta. In one embodiment this would be done on a periodic (time-based) basis, and/or it could be latched to a specific increase in the amount of GWC (i.e. 100 GWC increase) and/or the calculation(s) could be undertaken at the time a resultant from a gambling game is returned (which may or may not be inclusive of both a win or a loss or a push). In various embodiments, the change in GWC would be multiplied by at least one other operator that would reflect a prescribed ratio between the amount of GWC earned and quanta. In many embodiments, the amount of GWC can further be multiplied or divided by other operators related to one or more entertainment game variables, casino parameters, player attribute variables, etc. The formula or formulas to establish quanta from (at least in part) GWC could also add to (or subtract from) the aforementioned value (i.e. quanta multiplied or divided by one or more operators) amounts related to the aforementioned range of variables, said variables also being potentially multiplied or divided by at least one operator. Each part of the formula may also be raised to one or more exponents, for example.

Accordingly, a result of the gambling game, rather than being converted directly into the same element that initiated the wager in the first place (e.g. EE, AE, CEE) is converted into an intermediate quantity of quanta according to a process of function f2 1518 and/or function f5 1522.

In some embodiments, quanta can be used as the mechanism (in lieu of or in addition to GWC) to fund tournament entry. A player may gain entry to a tournament as a function of the amount of quanta they have earned (regardless of its disposition, i.e. regardless of whether they "spent" it or not) or their quanta balance (i.e. if they "spent" some they would have less on hand).

In various embodiments, a percentage of quanta generated via hybrid game game play can also be collected by the operator as a contribution to a prize pool that may subsequently be awarded as part of a tournament, and/or that is awarded as a prize to top performing players over a certain period of time, or over another measurable interval of time, performance, geography, etc.

Figure 16:
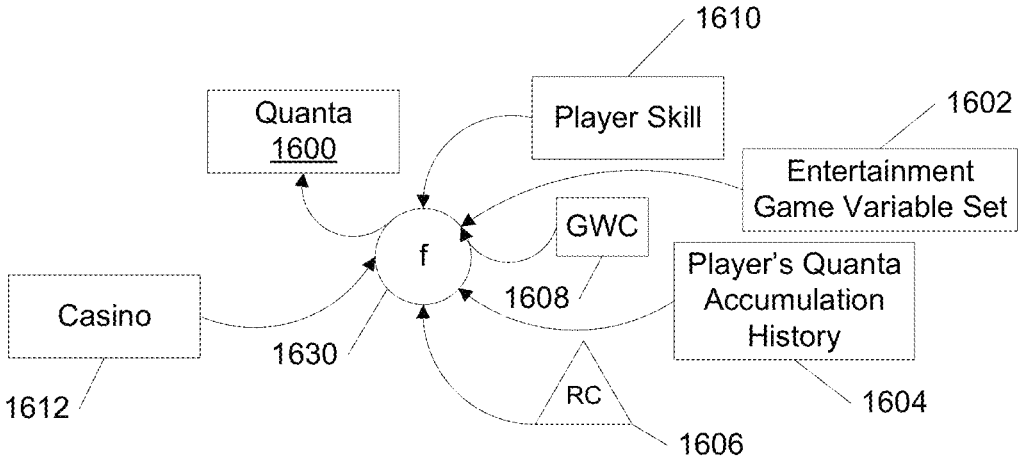
FIG. 16 is an illustration of the sources of intermediate credit hybrid game information used to determine an amount of an intermediate credit in accordance with an embodiment of the invention.

FIG. 16 is an illustration of the sources of intermediate credit hybrid game information used to determine an amount of an intermediate credit in accordance with an embodiment of the invention. FIG. 16 clarifies that quanta 1600 accumulation can be a function of any entertainment game variable 1602, and by extension the nature of ESE related activities, such as the player's performance in the context of the skill-based entertainment game, the performance of a competing player or players, the state of the entertainment game or gambling game environment, etc. In various embodiments, an amount of quanta generated and awarded to a player using inputs including, but not limited to, an entertainment game variable set 1602, a player's quanta accumulation history 1604, RC 1606 committed, won or lost, GWC 1608 accumulated, earned or lost, a player's skill 1610, an casino or operator's rules.

As illustrated in FIG. 16, the processes of any function, such as functions f2 1518 and f5 1522 (both of FIG. 15) can be replaced by a single function or set of functions (f 1630 for purposes of this diagram) that take player skill as an argument as well as historical information about the player's prior quanta accumulation across the current game session and/or multiple game sessions as well as a number of other inputs. Direct input from the casino or operator 1612 to these functions can also be made to award relatively more or less quanta for a given gambling game outcome or to reflect a multitude of prior gambling game outcomes.

In some embodiments, the amount of quanta a player receives after a gambling win is (at least) in part scaled as a function of the player's skill. The benefit of such a scaling is that players of higher skill can play against those of lower skill, with the relative amount of quanta being awarded to each player serving, to an extent, to balance the playing field between them. In this invention, it is also considered that a higher rate of quanta accumulation (i.e. a more aggressive scaling) may also lead to a scaling of GWC accumulation in the opposite direction (i.e. a player with more aggressive quanta accumulation may receive GWC at a lower rate than a player with a more modest awarding of quanta for the same gambling game outcome).

In various embodiments, quanta scaling is independent in that quanta scaling may take place as a function of the player's gambling commitments and wins from an RC (or VC) perspective, and that the various embodiments described herein are considered a layer on top of such scaling and modifications.

In some embodiments, a player, or the casino, or the game logic itself, may directly "dial in" the amount of quanta awarded as a function of gambling game outcomes, selecting to award relatively more or less quanta for a given outcome. This scaling may or may not also drive a modification in the rate at which GWC is awarded for entertainment game actions.

Figure 17:
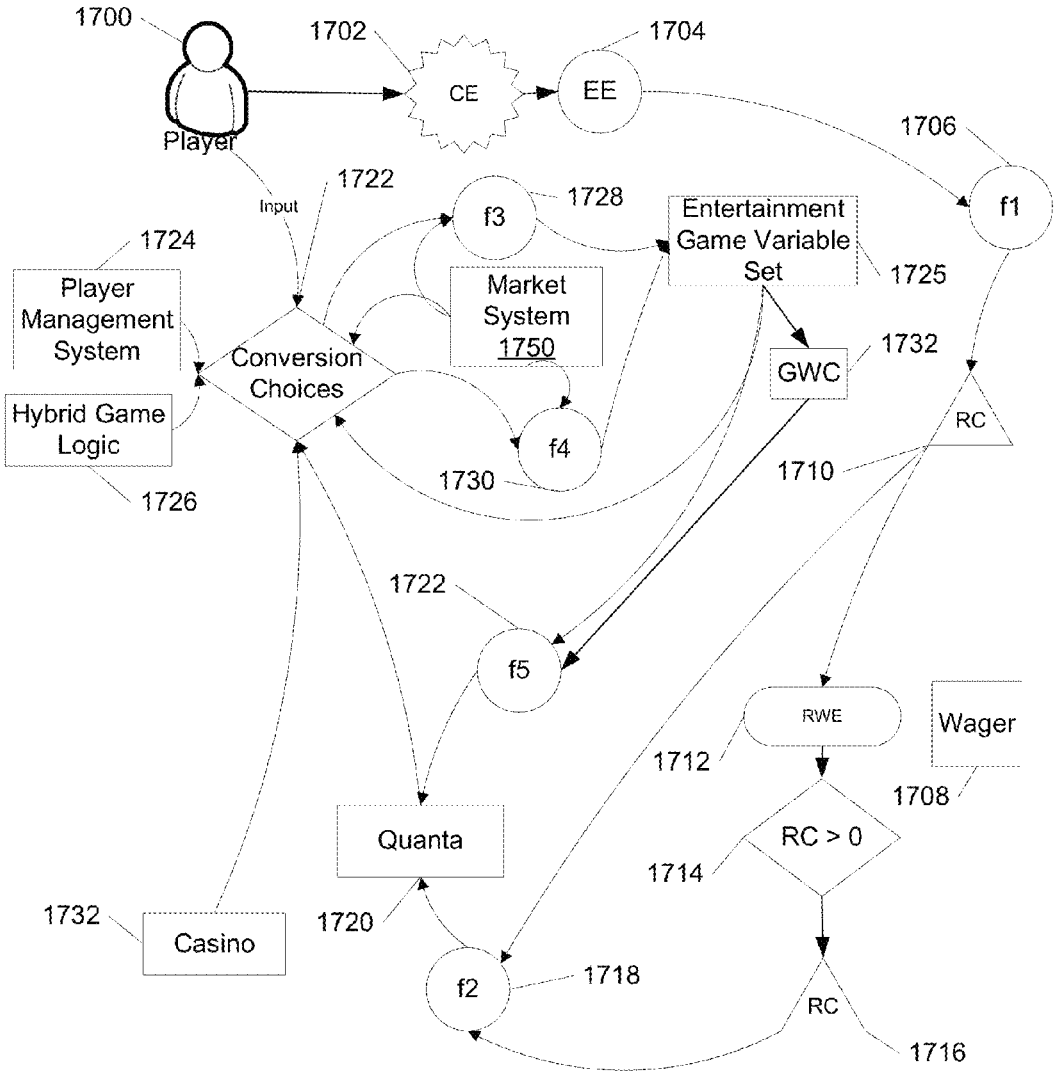
FIG. 17 is an illustration of a market system within an intermediate credit hybrid game in accordance with an embodiment of the invention.

FIG. 17 is an illustration of a market system within an intermediate credit hybrid game in accordance with an embodiment of the invention. As illustrated in FIG. 17, a player 1700 takes actions in an entertainment game that is part of an intermediate credit hybrid game. In many embodiments, the entertainment game is executed by an ESE (not shown). In some embodiments, the player's actions are taken using a controlled entity (CE) 1702. The player actions include utilization of an element, such as enabling element 1704. The utilization of the element triggers (as indicated by function f1 1706), a wager 1708 of real credit 1710 in a gambling game of the intermediate resource hybrid game. In many embodiments, the function f1 1706 is a process within a GWE (not shown). The wager is executed by an RWE 1712, resulting in a gambling game outcome. In response to the gambling outcome, the GWE generates quanta 1720. In many embodiments, an amount of quanta is generated based on a gambling outcome that is favorable to the player, such as winning (1714) an amount of real world credit 1716 as indicated by function f2 1718. In addition, quanta may be generated based on an amount of real world credit 1710 committed to the wager. Once the quanta is generated, a player may select various items and uses for the quanta in a conversion process. The actual selection may be influenced by a variety of factors and inputs. These factors include, but are not limited to, quanta conversion rules or functions, as indicated by functions f3 1728 and f4 1730, provided by a casino 1730 or other operator of the intermediate credit hybrid game, by the logic 1726 of the intermediate credit hybrid game, by a patron management system 1724, and by an entertainment game variable set 1725. Accordingly, a result of the gambling game, rather than being converted directly into the same element that initiated the wager in the first place (e.g. EE, AE, CEE) is converted into an intermediate quantity of quanta according to a formula or formulae embedded in f2. The quanta, which may or may not be observable to the player as part of hybrid game play, is ultimately converted into one or more elements (including but not limited to EE, AE, CEE, in-game objects, in-game currency, CEC, REC, CE attributes, etc.) in use within the entertainment game portion of the hybrid game. In some embodiments, quanta can also in some instances, though it need not be, be converted into RC, GWC, universal GWC, etc.

Quanta is converted into one or more of these downstream elements as a function of, but not limited to, one or more inputs and factors as described herein (though the choice of conversion is not limited solely to these drivers). The logic by which quanta is converted may be established at the onset of game play, in real time during game play, or at other times as dictated by the hybrid game, possibly as a function of casino input or other inputs: conversion choices affected by the player; casino choices (which may be temporal or permanent in nature or a combination thereof); variables within the entertainment game; variables within the player profile; GWE software hybrid game logic—which may or may not also take into account the entertainment game state, and/or other variables.

In FIG. 17, the selected conversion(s) are affected by functions f3 1728 and f4 1730. In some embodiments, a separate function may exist for each downstream variable or element into which quanta can be converted, or a more integrated function, subsuming multiple conversions, may be deployed, such that f3 and f4 (and/or additional functions as may exist) are replaced by a lesser number of more substantive functions of greater expanse.

In many embodiments, the conversion of quanta into a specific element or variable can be (a) affected at any time at the behest of a player and/or casino and/or the hybrid game logic itself as resident within the GWE, and/or (b) at specific times as dictated by game play and/or Hybrid Game logic, and/or casino and/or regulatory restrictions/rules or other inputs, etc. The point is that the conversion of quanta may be "latched" in so far as it may or may not be able to be undertaken at all times.

In several embodiments, the GWE of the intermediate credit hybrid game can also include functionality by which quanta are conserved across more than one game session, or quanta can only persist within a single game session. Quanta, like GWC in this regard, can also be subject to exchange across various games and/or domains. Alternately, a universal quanta can be deployed, or a standardized quanta system (analogous to GWC standardization across multiple game platforms) can be deployed to make quanta fungible across multiple game platforms and/or domains (e.g. casino property groups).

In some embodiments, quanta can be accumulated not just as a function of gambling game wins, but also as a function of GWC 1732. More generally, quanta can be accumulated as a function of any entertainment game variable. Function f5 1722 represents one or more formulae that convert GWC into an amount of quanta. In the more general case, the function f5 1722 can take in one or more entertainment game variables, inclusive of GWC.

In some embodiments, functions f2 1718 and f5 1722 can be replaced by a single function or set of functions (f2 for purposes of this diagram) that take RC and GWC as arguments, the amount of quanta resulting be a function of the relationship between the two.

In some embodiments, f5 1722 contains one or more processes that would convert a change in GWC into quanta. In one embodiment this would be done on a periodic (time-based) basis, and/or it could be latched to a specific increase in the amount of GWC (i.e. 100 GWC increase) and/or the calculation(s) could be undertaken at the time a resultant from a gambling game is returned (which may or may not be inclusive of both a win or a loss or a push). In various embodiments, the change in GWC would be multiplied by at least one other operator that would reflect a prescribed ratio between the amount of GWC earned and quanta. In many embodiments, the amount of GWC can further be multiplied or divided by other operators related to one or more entertainment game variables, casino parameters, player attribute variables, etc. The formula or formulas to establish quanta from (at least in part) GWC could also add to (or subtract from) the aforementioned value (i.e. quanta multiplied or divided by one or more operators) amounts related to the aforementioned range of variables, said variables also being potentially multiplied or divided by at least one operator. Each part of the formula may also be raised to one or more exponents, for example.

Accordingly, a result of the gambling game, rather than being converted directly into the same element that initiated the wager in the first place (e.g. EE, AE, CEE) is converted into an intermediate quantity of quanta according to a process of function f2 1718 and/or function f5 1722.

FIG. 17 further illustrates that a market system 1750 may govern the choices available to a player regarding the conversion of quanta and the effective pricing associated with such conversions as affected through, in this diagram, function f3 1728 and function f4 1730. The market system 1750, which can be a free market (i.e. dictated by player driven supply and demand) or controlled market (i.e. with pricing and/or supply regulated by the casino or operator 1724, game logic 1726 or other entity), can cause EE (or AE, or CEE, etc.) or entertainment game variables to be more or less abundant or scarce within the context of a single game session, across multiple game sessions, across specific geographic areas, across periods of game or real time, etc. singularly or in combination across more than one of these domains. Pricing (as affected through function f3 1728 and function f4 1730) can similarly be affected or controlled across one or more of these domains.

For example, in an embodiment of a first-person shooting game implemented as an intermediate credit hybrid game, the casino may specify that X number of grenades are available during a certain time frame. Alternatively, the casino may input that a player may not receive more than X grenades during a session of play. Both inputs govern the choices available to a player.

In another embodiment, an intermediate credit hybrid game version of a resources management game may have internal game logic that determines the conversion of quanta and the effective pricing associated with such conversions. For instance, in such a game, a player purchasing more wood resources through quanta than would normally be available may harm game mechanics. Therefore, a restriction on such purchases by increasing the price or decreasing availability may be input through the market system 1750.

In some embodiments, the market system operates in the context of the GWE, and may span multiple would span multiple intermediate credit hybrid games and/or intermediate credit hybrid game sessions through a mechanism similar to, or embedded within a game world credit exchange, with the understanding that the market system is in operation during actual intermediate credit hybrid game play session.

Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that a hybrid gaming system may be practiced otherwise than as specifically described. Thus, the foregoing description of the hybrid gaming system should be considered in all respects as illustrative and not restrictive, the scope of the claims to be determined as supported by this disclosure and the claims' equivalents, rather than the foregoing description.

What is claimed is:

1. An intermediate credit hybrid gaming system, comprising:

a processing device, connected to a casino slot machine via a network, configured to:

execute an entertainment game of skill;

determine an occurrence of a utilization of an element by a player during skillful play of the entertainment game of skill;

calculate an amount of game world credit accumulated by the player;

communicate, to the casino slot machine via the network, a signal to execute a wager of real world credits triggered by the utilization of the element by the player during skillful play of the entertainment game of skill;

communicate, to the casino slot machine via the network, a signal including the amount of game world credit accumulated by the player;

receive, from a game world engine, via the network, a signal including an outcome of a wager of real world credits triggered by the utilization of the element by the player during skillful play of the entertainment game of skill;

display the outcome of the wager of real world credits triggered by the utilization of the element by the player during skillful play of the entertainment game;

receive, from the casino slot machine, via the network, a signal including an amount of intermediate credit to award the player;

display the amount of intermediate credit to award the player; and receive from the player an input of a selection of a conversion of the amount of intermediate credit into the element to be utilized by the player in the entertainment game;

a real world engine, connected to the casino slot machine via a communication link, configured to:

receive, from the casino slot machine, via the communication link, a signal to execute a wager of real world credits triggered by the utilization of the element by the player during skillful play of the entertainment game of skill;

determine the outcome of the wager of real world credits triggered by the utilization of the element by the player during skillful play of the entertainment game of skill; and communicate, to the casino slot machine, via the communication link, the signal including the outcome of the wager of real world credits triggered by the utilization of the element by the player during skillful play of the entertainment game of skill; and the casino slot machine, connected to the processing device via the network and connected to the real world engine via the communication link, configured to:

continuously monitor the processing device's execution of the entertainment game of skill for a signal including the occurrence of the utilization of the element by the player during skillful play of the entertainment game of skill;

receive, from the processing device, via the network, the signal to execute the wager of real world credits triggered by the utilization of the element by the player during skillful play of the entertainment game of skill;

receive, from the processing device, via the network, the signal including the amount of game world credit accumulated by the player;

communicate, to the real world engine, via the communication link, the signal to execute the wager of real world credits triggered by the utilization of the element by the player during skillful play of the entertainment game of skill;

receive, from the real world engine, via the communication link, the signal including the outcome of the wager of real world credits triggered by the utilization of the element by the player during skillful play of the entertainment game of skill;

communicate, to the processing device, the signal including the outcome of the wager of real world credits triggered by the utilization of the element by the player during skillful play of the entertainment game of skill;

generate the amount of intermediate credit to award the player based on an amount of game world credit accumulated by the player; and communicate, to the processing device, via the network, the signal including the amount of intermediate credit to award the player.

2. The intermediate credit hybrid gaming system of claim 1 wherein the casino slot machine is further configured to generate the amount of intermediate credit further using one or more entertainment game variables.

3. The intermediate credit hybrid gaming system of claim 1 wherein the element when utilized by the player in the entertainment game triggers the determination of the result of the wager of real world credits.

4. The intermediate credit hybrid gaming system of claim 1 wherein the amount of intermediate credit can be used as a mechanism to fund tournament entry.

5. The intermediate credit hybrid gaming system of claim 1, wherein the real world engine and the game world engine are constructed from different processing apparatuses, and wherein the game world engine and the real world engine are connected by the network.

6. An intermediate credit hybrid gaming system, comprising:

a processing device, connected to a casino slot machine via a network, configured to:

execute an entertainment game of skill;

determine an occurrence of a utilization of an element by a player during skillful play of the entertainment game of skill;

calculate an amount of game world credit accumulated by the player;

communicate, to the casino slot machine via the network, a signal to execute a wager of real world credits triggered by the utilization of the element by the player during skillful play of the entertainment game of skill;

communicate, to the casino slot machine via the network, the amount of game world credit accumulated by the player;

receive, from a game world engine, via the network, a signal including an outcome of a wager of real world credits triggered by the utilization of the element by the player during skillful play of the entertainment game of skill;

display the outcome of the wager of real world credits triggered by the utilization of the element by the player during skillful play of the entertainment game;

receive, from the casino slot machine, via the network, a signal including an amount of intermediate credit to award the player;

display the amount of intermediate credit to award the player; and receive from the player an input of a selection of a conversion of the amount of intermediate credit into the element to be utilized by the player in the entertainment game; and the casino slot machine, connected to the processing device via the network and connected to a real world engine via a communication link, configured to:

continuously monitor the processing device's execution of the entertainment game of skill for a signal including the occurrence of the utilization of the element by the player during skillful play of the entertainment game of skill;

receive, from the processing device, via the network, the signal to execute the wager of real world credits triggered by the utilization of the element by the player during skillful play of the entertainment game of skill;

receive, from the processing device, via the network, a signal including an amount of game world credit accumulated by the player;

communicate, to the real world engine, via the communication link, the signal to execute the wager of real world credits triggered by the utilization of the element by the player during skillful play of the entertainment game of skill;

receive, from the real world engine, via the communication link, the signal including the outcome of the wager of real world credits triggered by the utilization of the element by the player during skillful play of the entertainment game of skill;

communicate, to the processing device, the signal including the outcome of the wager of real world credits triggered by the utilization of the element by the player during skillful play of the entertainment game of skill;

generate the amount of intermediate credit to award the player based on the amount of game world credit accumulated by the player; and communicate, to the processing device, via the network, the signal including the amount of intermediate credit to award the player.

7. The intermediate credit hybrid gaming system of claim 6 wherein the casino slot machine is further configured to generate the amount of intermediate credit further using one or more entertainment game variables.

8. The intermediate credit hybrid gaming system of claim 6 wherein the element when utilized by the player in the entertainment game triggers the determination of the result of the wager of real world credits.

9. The intermediate credit hybrid gaming system of claim 6 wherein the amount of intermediate credit can be used as a mechanism to fund tournament entry.

10. The intermediate credit hybrid gaming system of claim 6, wherein the real world engine and the game world engine are constructed from different processing apparatuses, and wherein the game world engine and the real world engine are connected by the network.

11. An intermediate credit hybrid gaming system, comprising:

a real world engine, connected to a casino slot machine via a communication link, configured to:

receive, from the casino slot machine, via the communication link, a signal to execute a wager of real world credits triggered by a utilization of an element by a player during skillful play of an entertainment game of skill;

determine an outcome of a wager of real world credits triggered by the utilization of the element by the player during skillful play of the entertainment game of skill; and communicate, to the casino slot machine, via the communication link, a signal including the outcome of the wager of real world credits triggered by the utilization of the element by the player during skillful play of the entertainment game of skill; and the casino slot machine, connected to a processing device via a network and connected to the real world engine via the communication link, configured to:

continuously monitor a processing device's execution of the entertainment game of skill for a signal including an occurrence of a utilization of the element by the player during skillful play of the entertainment game of skill;

receive, from the processing device, via the network, a signal to execute a wager of real world credits triggered by the utilization of the element by the player during skillful play of the entertainment game of skill;

receive, from the processing device, via the network, a signal including an amount of game world credit accumulated by the player;

communicate, to the real world engine, via the communication link, the signal to execute the wager of real world credits triggered by the utilization of the element by the player during skillful play of the entertainment game of skill;

receive, from the real world engine, via the communication link, the signal including the outcome of the wager of real world credits triggered by the utilization of the element by the player during skillful play of the entertainment game of skill;

communicate, to the processing device, the signal including the outcome of the wager of real world credits triggered by the utilization of the element by the player during skillful play of the entertainment game of skill;

generate an amount of intermediate credit to award the player based on the amount of game world credit accumulated by the player; and communicate, to the processing device, via the network, a signal including the amount of intermediate credit to award the player.

12. The intermediate credit hybrid gaming system of claim 11 wherein the casino slot machine is further configured to generate the amount of intermediate credit further using one or more entertainment game variables.

13. The intermediate credit hybrid gaming system of claim 11 wherein the element when utilized by the player in the entertainment game triggers the determination of the result of the wager of real world credits.

14. The intermediate credit hybrid gaming system of claim 11 wherein the amount of intermediate credit can be used as a mechanism to fund tournament entry.

* * * * *